US011459145B2

(12) United States Patent
Su

(10) Patent No.: US 11,459,145 B2
(45) Date of Patent: Oct. 4, 2022

(54) COLLAPSABLE BOX

(71) Applicant: SHANGHAI HONGYAN RETURNABLE TRANSIT PACKAGINGS CO., LTD, Shanghai (CN)

(72) Inventor: Yongping Su, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 227 days.

(21) Appl. No.: 16/304,225

(22) PCT Filed: May 23, 2017

(86) PCT No.: PCT/CN2017/085565
§ 371 (c)(1),
(2) Date: Nov. 23, 2018

(87) PCT Pub. No.: WO2017/202310
PCT Pub. Date: Nov. 30, 2017

(65) Prior Publication Data

US 2020/0317393 A1 Oct. 8, 2020

(30) Foreign Application Priority Data

May 24, 2016 (CN) ..... 201610349670.3

(51) Int. Cl.
*B65D 6/18* (2006.01)
*B65D 21/02* (2006.01)

(52) U.S. Cl.
CPC ..... *B65D 11/1833* (2013.01); *B65D 21/0226* (2013.01)

(58) Field of Classification Search
CPC ..... B65D 11/1833; B65D 21/0226; B65D 211/1846; B65D 21/0235; B65D 21/0223; B65D 18/18
(Continued)

(56) References Cited

U.S. PATENT DOCUMENTS 5,279,438 A * 1/1994 Cesano ..... B65D 5/006 220/684
6,142,329 A * 11/2000 Dotan ..... B65D 19/18 220/4.33
(Continued)

FOREIGN PATENT DOCUMENTS

CN 1182398 A 5/1998
CN 2400369 Y 10/2000
(Continued)

OTHER PUBLICATIONS

Office Action issued in corresponding Japanese Patent No. 2018-561239, dated Oct. 3, 2019, with English machine translation; 14 pages provided.
(Continued)

*Primary Examiner* — Rafael A Ortiz
*Assistant Examiner* — Sanjidul Islam
(74) *Attorney, Agent, or Firm* — Hamre, Schumann, Mueller & Larson, P.C.

(57) ABSTRACT

Disclosed is a collapsible box, comprising a base (1) and two pairs of opposite side plates. A protrusion edge (10) is provided at the periphery of the base (1). The side plates are hinged to the base and foldable relative to the base (1). Each of the side plates is smooth at both sides thereof and at least one pair of the side plates are each provided with a cavity in lower edges. When a collapsible box (100) is deployed, the lower edges of one pair of side plate are connected with the lower edges of the other pair of side plates so as to form a
(Continued)

frame. The frame is hinged to the base (1) by means of hinges, so as to form a reinforced structure which resists the base from depressing and the protrusion edge from recessing. This solution increases the cleaning efficiency of the collapsible box, alleviates the depressing of the base when the box body is loaded, and solves the problem of the collision and damage among goods in upper and lower layers due to the depressing of the base due to multi-layer stacking of collapsible boxes. Further, the safety risk in warehouse storage caused by the failure of stacking due to side plate deformation caused by multi-layer stacking of collapsible boxes and side plates being pressed is avoided. Meanwhile the box has a smaller wall thickness and a higher folding ratio.

16 Claims, 28 Drawing Sheets

(58) Field of Classification Search
USPC ..... 220/6, 7, 4.32, 4.29, 4.28; 206/600
See application file for complete search history.

(56) References Cited

U.S. PATENT DOCUMENTS

| | | | | |
|---|---|---|---|---|
| 6,290,081 | B1 * | 9/2001 | Merey | B65D 11/1833 220/7 |
| 6,820,761 | B1 * | 11/2004 | Mouri | B65D 11/1833 206/600 |
| 7,017,766 | B2 * | 3/2006 | Hsu | B65D 11/1833 220/6 |
| 7,100,786 | B2 * | 9/2006 | Smyers | B65D 11/1833 220/6 |
| 2002/0000641 | A1 | 1/2002 | Groves et al. | |
| 2002/0179601 | A1 * | 12/2002 | Haruhiro | B65D 11/1833 220/6 |
| 2004/0178197 | A1 * | 9/2004 | Hsu | B65D 11/1833 220/7 |
| 2007/0194023 | A1 * | 8/2007 | Apps | B65D 21/062 220/6 |
| 2009/0101640 | A1 * | 4/2009 | Hadar | B65D 11/1833 220/7 |
| 2009/0134176 | A1 * | 5/2009 | Yamauchi | B65D 11/1833 220/666 |
| 2011/0049144 | A1 * | 3/2011 | Koefelda | B65D 11/1833 220/6 |
| 2012/0305434 | A1 | 12/2012 | Nolet et al. | |

FOREIGN PATENT DOCUMENTS

| | | | | | |
|---|---|---|---|---|---|
| CN | 1332689 | A | | 1/2002 | |
| CN | 203903187 | U | | 10/2014 | |
| CN | 104369947 | A | | 2/2015 | |
| CN | 104691892 | A | | 6/2015 | |
| CN | 105836254 | A | | 8/2016 | |
| DE | 202004015081 | U1 | | 2/2006 | |
| EP | 1477414 | A1 | * | 11/2004 | B65D 21/0235 |
| EP | 1767460 | A1 | * | 3/2007 | B65D 19/18 |
| EP | 2996951 | B1 | * | 7/2017 | B65D 19/18 |
| JP | 2002529335 | | | 9/2002 | |
| JP | 2003312659 | A | | 11/2003 | |
| JP | 2004090999 | A | | 3/2004 | |
| JP | 2004090999 | A | * | 3/2004 | |
| JP | 2004224418 | A | | 8/2004 | |
| JP | 2004268972 | A | | 9/2004 | |
| WO | 9718704 | A1 | | 5/1997 | |
| WO | WO-2006119513 | A1 | * | 11/2006 | B65D 11/1833 |
| WO | 2009050689 | A1 | | 4/2009 | |
| WO | WO-2013047706 | A1 | * | 4/2013 | B65D 19/18 |

OTHER PUBLICATIONS

The extended European search report issued in European Application No. 17802156.4, dated Nov. 26, 2019.
Examination Report issued in Australian Patent Application No. 2017269437, dated Mar. 26, 2019.
Examination Report issued in Australian Patent Application No. 2017269437, dated Oct. 23, 2019.
International Search Report (English and Chinese) and Written Opinion issued in PCT/CN2017/085565, dated Jul. 6, 2017.

* cited by examiner

COLLAPSABLE BOX

TECHNICAL FIELD

The invention relates to a container, in particular to a collapsible box.

BACKGROUND

The existing collapsible box has a fixed side plate thickness and height. When in use, the side plates need to be oppositely unfolded and erected, and the four side plates are interlocked, so that a relatively closed space is formed for accommodating goods. After the boxes are emptied, they need to be recycled. In order to reduce the cost maximally, the side plates of the box can be folded, so that more boxes to be recycled can be contained in the same space. The boxes should be convenient to be cleaned in the recycling process, and especially when the collapsible box is used for loading foods such as fruits and vegetables, the cleaning after using is particularly important. Meanwhile, the box needs to be strong and reliable in use, and the side plates need to be unlocked and folded easily and rapidly when the boxes are emptied. However, the prior collapsible box, for example, as described in US 20090101640A1, the side plate thereof is composed of a thin wall and an arrangement of reinforcing ribs on the surface of the thin wall, the side plate structure has two shortcomings. Firstly, during cleaning, the dirt remained in the recessed parts between the grid ribs are difficult to remove, so the cleaning efficiency is low. Secondly, the thin-wall structure is weak in bending-resistance and compression-resistance, in particular the hinged part of the side plate and the base. Because the side plate made of a single thin wall withstand the hinges, especially when the box is loaded with high-density goods, the inner surface of the base is depressed, then since the side plate is hinged to the protrusion edge of the base through the hinges, the protrusion edge will tilt inwardly with the depressing of the base, and the side of the side plate close to the hinge will also deform and bend inwardly due to being drawn by the protrusion edge.

Thus, the side plate, in particular the lower edge close to the hinge functions to support and correct the depressing of the base and the inward deformation of the protrusion edge under the condition that the height of the base protrusion edge is defined. Therefore, in the prior art, the part of the side plate close to a hinge part is composed of a single thin wall, and when the load is increased, the deformation caused by inward tilting of the protrusion edge cannot be resisted, the base of the box will depress, and further cause the inward tilting of the protrusion edge and further deformation of the side plates. When the side plates cannot assist and improve the inward recessing of the base, when a multiple layers of boxes are stacked, the goods in the lower layer can be pressed by the goods in the upper layer due to the depressing of the base formed by a thin wall. So, safety of goods can not be assured, particularly, when the box is used for loading fragile goods such as beverages, milk bottles and the like. Due to the deformation of the box base, the collision and damage between goods in adjacent layers can be easily caused. When the box is repeatedly used, and fatigue damage is easily caused due to the large stress deformation in the frequent high-low temperature switching environment switching, so that the service life of the box body is shortened.

SUMMARY

The invention aims to provide a collapsible box, to solve the existing problems in the prior art.

In order to solve the problem, according to one aspect of this invention, a collapsible box is provided, wherein the collapsible box comprises a base and two pairs of opposite side plates, and protrusion edges are arranged on the periphery of the base, the side plates are hinged to the base and foldable relative to the base, wherein each of the side plates is a dual-smooth side plate, and at least one pair of the side plates are each provided with a cavity in lower edge, and when the collapsible box is deployed, the lower edges of one pair of side plates of the two pairs of opposite side plates are connected with the lower edges of the other pair of side plates to form a frame, and the frame is hinged to the base through hinges, so as to form a reinforcing member which resists the base from depressing and the protrusion edge from recessing.

Preferably, the part, provided with the cavity, of the side plate is flush with the adjacent part.

Preferably, at least one concave part extending along the height direction of the side plate is arranged on the outer side surface of the side plates, wherein the concave part is shaped such that when two adjacent collapsible boxes abut to each other, a cavity in the height direction of the side plate is formed.

Preferably, the cavity is formed within the thickness of the side plate.

Preferably, the cavity extends along the length direction of the side plate for a predetermined length, wherein the range of the predetermined length is 0.8-1 times of the length of the side plate.

Preferably, the two concave parts are arranged close to the connecting parts at the left and right ends of the side plate respectively, wherein at least one another concave part is arranged between the two concave parts.

Preferably, the depth range of the concave part in the thickness direction of the side plate is 0.1-0.9 times of the thickness of the side plates.

Preferably, the height range of the concave part is 0.1-0.9 times of the height of the side plate.

Preferably, a cavity extending in the height direction of the side plate is provided in the side plate.

Preferably, a plurality of cavities extending in the height direction and spacing apart from each other are provided in the side plate.

Preferably, a plurality of cavities extending in the length direction of the side plate and spacing apart from each other are provided in the side plate.

Preferably, a cavity extending along the length direction of the side plate is provided in the upper edge of the side plate, and a cavity extending along the height direction of the side plate is provided in the left end part or the right end part of the side plate.

Preferably, cavities formed in the upper edge and the lower edge of the side plate and a cavity formed in the left end part of the side plate form a C-shaped structure, and/or a cavity formed in the upper edge and the lower edge of the side plate and a cavity formed in the right end part of the side plate form a reversed C-shaped structure.

Preferably, a cavity extending along the length direction of the side plate is provided in the upper edge of the side plate, a cavity extending along the height direction of the side plate in the left and right end parts of the side plate, wherein the cavity formed in the upper edge of the side plate is in fluid communication with the cavity formed in the left and right end parts, and the cavity formed in the lower edge of the side plate is spaced apart from the cavity formed in the left and right end parts of the side plate.

The cavity formed in the lower edge of the side plate and the cavities formed in the left and right end parts of the side plate are spaced apart from each other at the lower left corner and the lower right corner of the side plate respectively.

Preferably, a cavity extending along the length direction of the side plate is provided in the upper edge of the side plate, and cavities extending along the height direction of the side plate are provided in the left and right end parts of the side plate respectively, the cavities in the left and right end parts of the side plate comprise an upper cavity and a lower cavity which are separated along the height direction of the side plate.

Preferably, the side plate is provided with a plurality of air holes, which are distributed in the area enclosed by the cavity formed along the length direction of the side plate and the cavity formed along the height direction.

Preferably, the cavity is a gas-assisted molding cavity.

According to another aspect of the invention, a collapsible box is provided, wherein the collapsible box comprises a base and two pairs of opposite side plates, the side plates are hinged to the base and foldable relative to the base, wherein each of the side plates is a dual-smooth side plate, a cavity extending a predetermined length along the side plate is provided in at least one side plate, and at least one concave part extending along the height direction of the side plate is arranged on the outside surface of the side plate, wherein the concave part is shaped so that when two adjacent collapsible boxes abut to each other, a cavity in the height direction of the side plate is formed.

Preferably, the two concave parts are arranged close to the connecting parts at the left end and the right end of the side plate respectively, wherein at least one concave part is arranged between the two concave parts.

Preferably, at least one concave part extending along the height direction of the side plate is arranged on the outer side surface of the side plate, wherein the concave part is shaped so that when two adjacent collapsible boxes abut to each other, a cavity in the height direction of the side plate is formed.

Preferably, the range of the predetermined length is 0.8-1 times of the length of the side plate.

Preferably, the cavity is formed within the thickness of the side plate.

Preferably, the depth range of the concave part along the thickness direction of the side plate is 0.1-0.9 times of the thickness of the side plates.

Preferably, the length range of the concave part in the height direction of the side plate is 0.1-0.9 times of the height of side plates.

Preferably, the cavity extends along the height direction of at least one side plate.

Preferably, a plurality of cavities extending in the height direction and spaced from each other are arranged in the side plate.

Preferably, the cavity extends along the length direction of the at least one side plate.

Preferably, a plurality of cavities extending in the length direction of the side plate and spaced apart from each other are provided in the side plate.

Preferably, the side plate is provided with a plurality of air holes, the plurality of air holes are distributed in an area enclosed by a cavity formed in the length direction of the side plate and a cavity formed along the height direction.

Preferably, the cavity is a gas-assisted molding cavity.

According to a further aspect of this invention, a collapsible box is provided, wherein the collapsible box comprises a base and two pairs of opposite side plates, the side plates are hinged to the base and foldable relative to the base, wherein each of the side plates is a dual-smooth side plate, at least one side plate is internally provided with a cavity extending a predetermined length along the side plate, and a protrusion is provided on the top surface of the side plate, a pocket engageable with the protrusion is formed on the lower bottom surface of the base, and when a multiple of collapsible boxes are stacked, the positioning protrusion of the top surface of the side plate of the lower collapsible box is inserted into the pocket of the lower bottom surface of the base of the upper collapsible box.

Preferably, at least two protrusions are arranged on the top surface of each side plate.

Preferably, the range of the predetermined length is 0.8-1 times of the length of the side plate.

Preferably, the outside surface of the side plate is provided with a concave part extending in the height direction.

Preferably, the depth range of the concave part in the thickness direction of the side plate is 0.1-0.9 times of the thickness of the side plate.

Preferably, the height range of the concave part is 0.1-0.9 times of the height of the side plate.

Preferably, the cavity extends along the height direction of at least one side plate.

Preferably, a plurality of cavities extending in the height direction and spaced apart from each other are arranged in the side plate.

Preferably, the cavities extend along the length direction of the at least one side plate.

Preferably, a plurality of cavities extending in the length direction of the side plate and spaced apart from each other are provided in the side plate.

Preferably, the side plate is provided with a plurality of air holes, which are distributed in an area enclosed by a cavity formed in the length direction of the side plate and a cavity formed along the height direction.

Preferably, the cavity is a gas-assisted molding cavity.

According to another aspect of the invention, a collapsible box is provided, wherein the collapsible box comprises a base and two pairs of opposite side plates, the side plates are hinged to the base and foldable relative to the base, wherein each of the side plates is a dual-smooth side plate, and a cavity extending a predetermined length in the length direction of the side plate is formed in the lower edge of the at least one pair of side plates, and the lower edges formed with the cavity is connected with the lower edge the other pair of opposite side plates to form a frame.

Preferably, the two cavities extend along the height direction of the side plate and are provided in the connecting parts at the left and right ends of the side plate respectively.

Preferably, the cavity extends from the upper edge to the lower edge of the side plate in the height direction, or extends downwards from the upper edge of the side plate for a predetermined length, or extends upwards from the lower edge of the side plate for a predetermined length.

Preferably, cavities extending along the length direction of the side plate are provided in the upper edge and/or the lower edge of each side plate, so that when the two pairs of opposite side plates are in the deployed state, and the cavities in the upper edges of the two pairs of opposite side plates form a rectangular frame, and/or the cavities in the lower edges of the two pairs of opposite side plates form a rectangular frame.

Preferably, the length-width ratio of the collapsible box is 3:2, wherein a plurality of rows of pockets in the width direction of the base are formed in the bottom surface of the base.

Preferably, a plurality of pockets are formed at ⅓ and ⅔ of the length of the base on the lower bottom surface of the base.

Preferably, the cavity extends along the length direction of the side plate and is provided in the upper edge and/or the lower edge of the side plate.

Preferably, at least one part of the cavity extends along the length direction of the side plate in the upper edge of the side plate, and at least another part of the cavity extends along the height direction of the side plate in the connecting parts at the left and right ends of the side plate, and at least another part of the cavity extends in the length direction of the side plate in the lower edge of the side plate.

Preferably, at least one part of the cavity extends from the left end to the right end along the length direction of the side plate in the upper edge of the side plate, and at least another part of the cavity extends from the lower edge to the upper edge in the height direction of the side plate in the connection parts of the left and right ends of the side plate, and at least yet another part of the cavity extends from the left end to the right end in the length direction of the side plate in the lower edge of the side plate.

Preferably, the cavity extending along the length direction of the side plate and the cavity extending along the height direction of the side plate are spaced apart from each other.

Preferably, a plurality of cavities extending along the length direction of the side plate and spaced apart from each other are provided in the lower edge of the side plate.

Preferably, a hinge seat is provided on the lower side of the lower edge of the side plate, hinge pins are arranged at the two ends of the hinge base, a hanging shoulder is arranged in the middle of the hinge seat, and a hinge groove is formed in the base, a first limiting boss and a second limiting boss are arranged in the hinge groove, wherein the hanging shoulder is engageable with the first limiting boss, wherein the hinge pins are engageable with the second limiting boss.

Preferably, the ends of the hinge pin are provided with third limiting bosses; the contour of the third limiting boss is engageable with the second limiting boss.

Preferably, the side plates are hinged to the base through hinges, reinforcing structures are provided on the lower edges of the two pairs of opposite side plates, and the reinforcing structure is provided above the hinge.

Preferably, the lower side of the lower edge of the side plate is provided with a hinge seat, hinge pins are provided at the two ends of the hinge seat, and protrusion edges are arranged on the base, a hinge groove engageable with the hinge seat is formed in the protrusion edge, the protrusion edge is further provided with a cavity formed along the length direction of the protrusion edge. According to the collapsible box in this invention, the bending resistance of the side plate is improved maximally so as to resist the deformation of the protrusion edge of the base, so that the problem of extrusion damage among goods due to the fact that the box base depresses when being pressed can be solved.

According to the collapsible box, the problem of dirt remained after cleaning during repeated use of the collapsible box can be maximally reduced, the cleaning efficiency is improved, the depressing of the base after the box is loaded is alleviated, and the problem that when multiple layers of collapsible boxes are stacked, and the problem that the goods are damaged due to mutual collision between the goods in upper and lower layers due to the fact that the base is depressed when a multiple layers of collapsible boxes are stacked are avoided. Meanwhile, when the side plate of the box is thin, the folding efficiency is high, and the side plates are pressed due to the stacking of a multiple layers of boxes, the safety risky of storage caused by stacking failure due to the deformation of the side plates is solved.

BRIEF DESCRIPTION OF THE DRAWINGS

FIGS. 14-16 show the state of the collapsible box when pressed, wherein FIG. 14 shows the cross section of the collapsible box when the collapsible box is pressed, FIG. 15 shows the base before deformation, and FIG. 16 shows the base after deformation.

FIGS. 17-19 show stress state of each side plate of the collapsible box of this invention, wherein FIG. 17 is the top view, FIG. 18 is the cross-sectional view, and FIG. 19 is another cross-sectional view.

EMBODIMENTS

Figure 1:
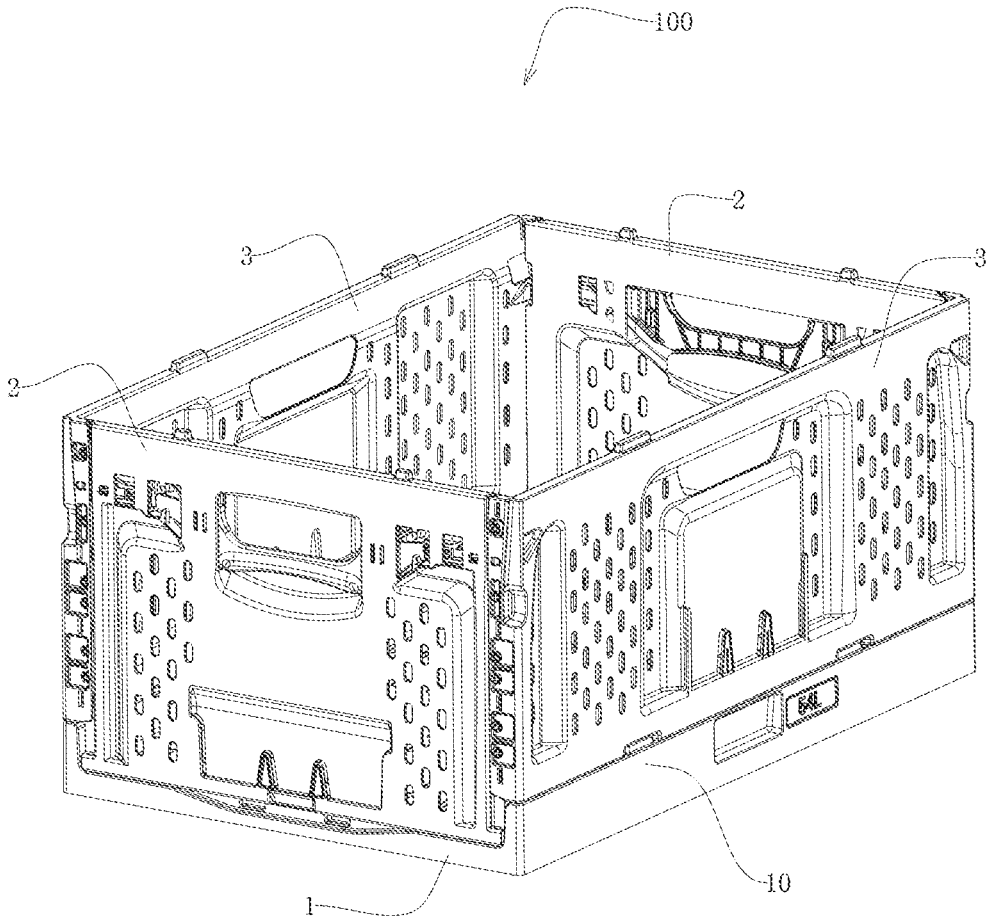
FIG. 1 is a perspective view of a collapsible box of this invention, with the side plate in erected state.

The preferred embodiment of this invention will be described in detail with reference to the accompanying drawings, so that the purposes, the characteristics and the advantages of the invention can be more clearly understood. It should be understood that the embodiments shown in the figures are not intended to limit the scope of this invention, but illustrate the essential spirit of the technical solution of this invention.

Terms

In the invention, the dual-smooth side plate means that compared to the traditional side plate with reinforcing ribs on the side surface thereof, the side surfaces of the dual-smooth side plate have no or little reinforcing ribs.

The upper edge of the side plate refers to a portion extending downwards from the top surface of the side plate.

The lower edge of the side plate refers to a portion extending upwards from the bottom surface of the side plate Basing on the existing defects, this invention provides a collapsible box which is foldable and easy to clean, with long and short side plates formed by air-assisted molding, and with the side plates being reinforced by a rectangular frame work presented by themselves, so that the torsion resistance and the deformation resistance are improved. When the base bears heavy goods, the flat base will generally be depressed, then, the protruded portion on the long edge of the base will incline toward inside of the base, and the long side edge of the base is displaced towards the center of the box. Since the base is hinged to the side plate through hinges, when the base moves inwards, the lower edge of the side plate will be correspondingly dragged by the base so that the middle part of the side plate will deform by bending towards the inside of the box body. So, not only the side plates formed by the air-assisted process are supported by the jointed hollow frame work in the whole periphery, but also the lower end of the side plate where the hinges are provided and the base is hinged is rectangular in cross section, the bending resistance thereof is much better than the reinforcing ribs arranged on the thin wall plate. So, the bending resistance of the side plate is improved maximally so as to resist the deformation of the protrusion edge of the base, so that the problem of extrusion damage among goods due to the fact that the box base depresses when being pressed can be solved.

The collapsible box of the invention generally comprises a base and two pairs of opposite side plates, the side plates are hinged to the base and foldable relative to the base. The side plates of the collapsible box are dual-smooth side plate, and at least one side plate is internally provided with a cavity extending a predetermined length along the side plates, and the cavity is formed within the thickness of the side plates, so that the part, provided with the cavity, of the side plate is flush with the adjacent part. That is, the cavity is located between the inner side surface and the outer side surface of the side plate. So, when viewing from outside, the part where the cavity is provided of the side plate do not protrude beyond the inner side surface and the outer side surface of the side plate. The term "adjacent part" used above means the part adjacent to the part provided with the cavity and in which a cavity is not provided of the side plate. The length range of the predetermined length is 0.8-1 times of the length of the side plate or 0.8-1 times of the height of the side plate.

In one embodiment of this invention, cavities are formed in the lower edges of at least one pair of side plates of the collapsible box. When the collapsible box is deployed, the lower edges of one pair of side plates of the two pairs of opposite side plates are connected with the lower edges of the other pair of side plates to form a frame, and the frame is hinged to the base through hinges so as to form a reinforcing structure for resisting the depressing of the base and the inward recessing of the protrusion edge. Due to the fact that the cavities are formed in at least one pair of lower edges of the frame, the overall strength of the frame is greatly enhanced, so that a reinforcing structure for resisting the depressing of the base and the inward recessing of the protrusion edge is formed.

Figure 2:
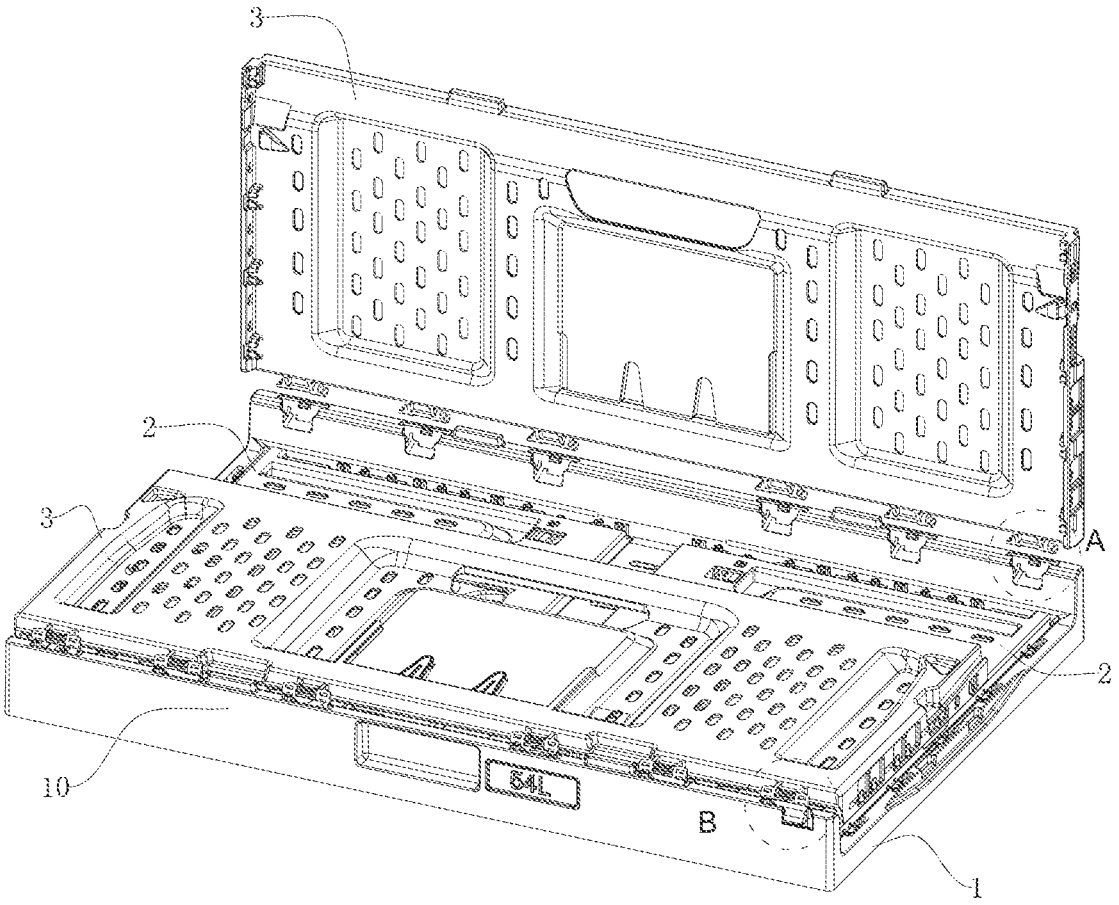
FIG. 2 is another perspective view of the collapsible box of this invention, with some of the side plates in folded state.

FIG. 1 is a perspective view of a collapsible box of this invention, with the side plate in erected state; FIG. 2 is another perspective view of the collapsible box of this invention, with some of the side plates in folded state. As shown in FIGS. 1-2, the collapsible box 100 comprises a base 1, a pair of short side plates 2, 2 and a pair of long side plates 3 and 3, wherein a protrusion edge 10 is arranged on the base 1 and the short side plates 2 and the long side plates 3 are respectively hinged to the base 1 and foldable relative to the base 1. The long side plate 3 and the short side plate 2 are both dual-smooth side plates. The adjacent long side plates and the short side plates are detachably lockable through a locking mechanism and at least one side plate is internally provided with a cavity extending a predetermined length along the side plates. Preferably, the long and short side plates are made of high-strength materials such as high-strength plastics.

Figure 5:
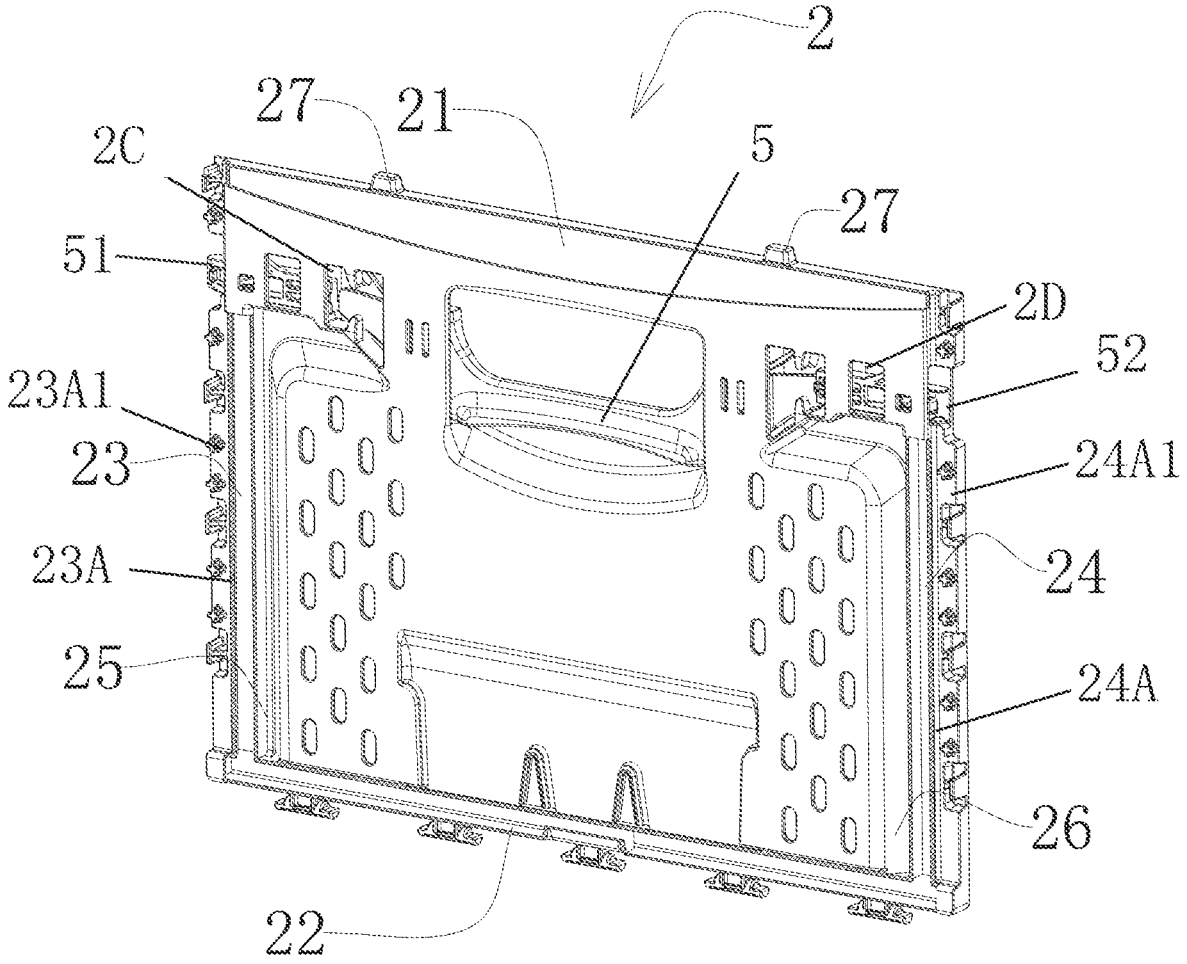
FIG. 5 is a perspective view of a short side plate according to one embodiment of this invention.
Figure 6:
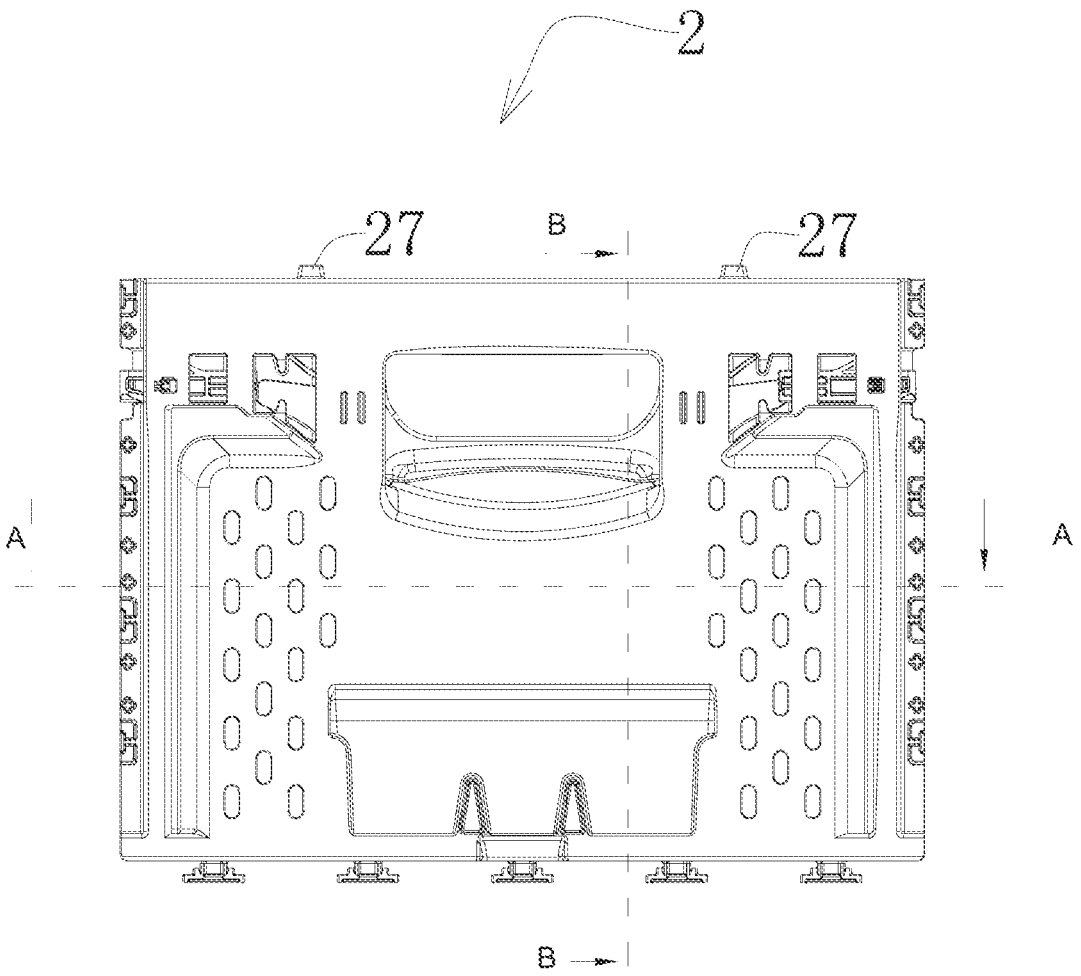
FIG. 6 is a front view of the short side panel of FIG. 5.
Figure 7:
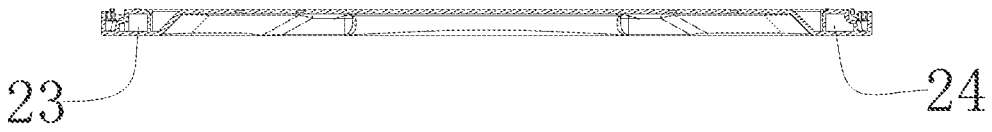
FIG. 7 is a cross-sectional view taken along line A-A of the short side plate of FIG. 5.
Figure 8:
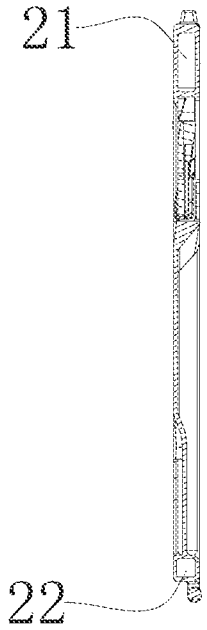
FIG. 8 is a cross-sectional view taken along line B-B of the short side plate of FIG. 5.

FIG. 5 is a perspective view of a short side plate of the embodiment; and FIG. 6 is a front view of the short side plate of FIG. 5; FIG. 7 is a cross-sectional view taken along line A-A of the short side plate of FIG. 5; FIG. 8 is a cross-sectional view taken along line B-B of the short side plate of FIG. 5. The short side plates are provided with locking mechanism mounting holes 2C and 2D. The locking tongues 51 and 52 of the locking mechanism 5 can pass through the mounting holes 2C and 2D to enter the adjacent long side plates respectively, so that the long side plate and the short side plate are mutually locked. As shown in FIGS. 5-8, the upper edge of the short side plate 2 is provided with a cavity 21 formed in the length direction thereof, and the lower edge is provided with a cavity 22 formed in the length direction thereof, and the left end part is provided with a cavity 23 formed in the height direction thereof, and the right end part is provided with a cavity 24 formed in the height direction thereof. Preferably, the cavities in the upper and lower edges, the left and right end parts of short side plate 2 are formed through air-assisted injection molding. Preferably, the cross sections of the cavities 21, 22, 23 and 24 are rectangular.

As shown in FIG. 5, and a concave part 25 extending in the height direction is arranged adjacent to the left end of the short side plate 2 on the outer side surface of the short side plate 2, and a concave part 26 extending in the height direction is arranged adjacent to the right end of the short side plate 2 on the outer side surface of the short side plate 2. When the plurality of collapsible boxes 100 are stacked together, the concave parts 25 and 26 on the adjacent short side plates 2 of the adjacent collapsible box form a cavity along the height direction of the side plate, and the cavity is used for supporting the base of the upper-layer collapsible box, so that the base of the upper layer of collapsible box is prevented from depressing, which will be further described later.

Preferably, cavities 23 and 24 in the left and right ends of the short side plate 2 are respectively arranged in the connecting parts 23A and 24A of the short side plates 2, and the concave parts 25, 26 are provided adjacent to the connecting parts 23A and 24A of the left end and the right end of the short side plate 2 respectively, and the connecting part 23A and the connecting part 24A are used for being connected with the adjacent long side plates. The connecting parts 23A and 24A are respectively provided with engaging structures 23A1 and 24A1, and the engaging structures of the short side plates are used for being engaged with the corresponding engaging structures of the long side plates, so that the short side plates are connected with the adjacent long side plates. Although in this embodiment, the short side plate 2 is provided with concave parts only at the left and right ends. However, it can be understood that one or more concave parts can be further arranged between the concave parts 25 and 26. Preferably, the height range of the concave parts 25, 26 is 0.1 to 0.9 times of the height of the side plates 2, and the depth range of the concave parts 25, 26 in the thickness direction of the short side plate 2 is 0.1-0.9 times of the thickness of the side plate 2.

As shown in FIG. 5, a plurality of vents 28 are formed in the short side plate 2, and the vents 28 are distributed in area enclosed by the cavities 23, 24 formed in the length direction of the side plates and the cavities 25 and 26 formed in the height direction. Positioning protrusions 27 are arranged on the top surface of the short side plate 2, pockets 11 complementary with the protrusion 27 are formed in the lower bottom surface of the base, and when a multiple of collapsible boxes are stacked, and the positioning protrusions 27 of the top surface of the side plate of the lower collapsible box is inserted into the pockets of the lower bottom surface of the base of the upper collapsible box, so that the collapsible boxes in the upper layer and the lower layer can be positioned relative to each other, which will be described in detail below.

Figure 9:
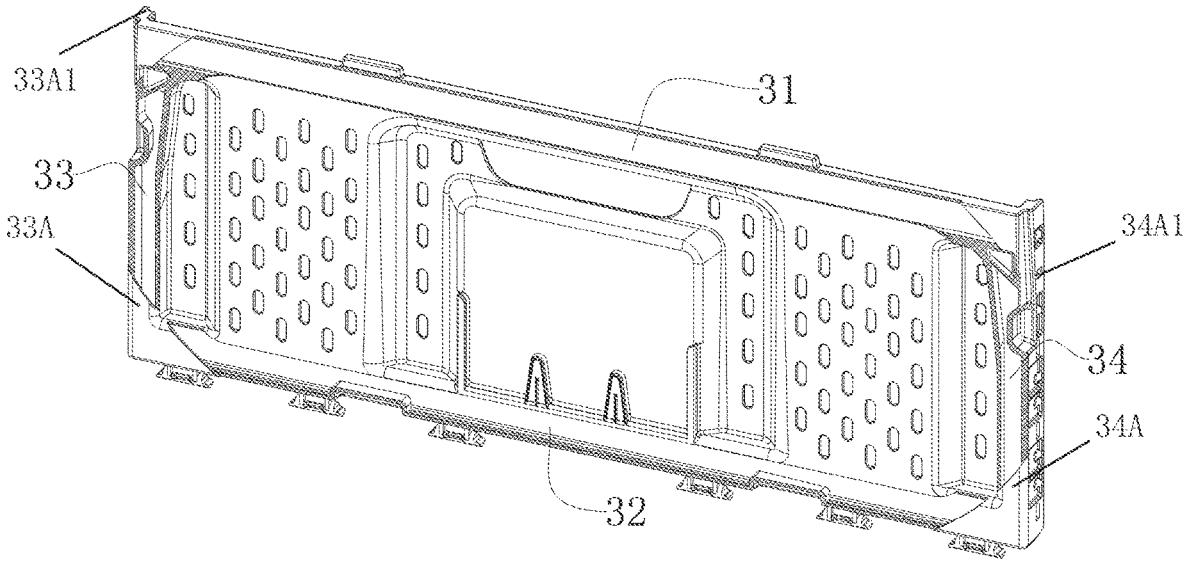
FIG. 9 is a perspective view of a long side plate according to one embodiment of this invention.
Figure 10:
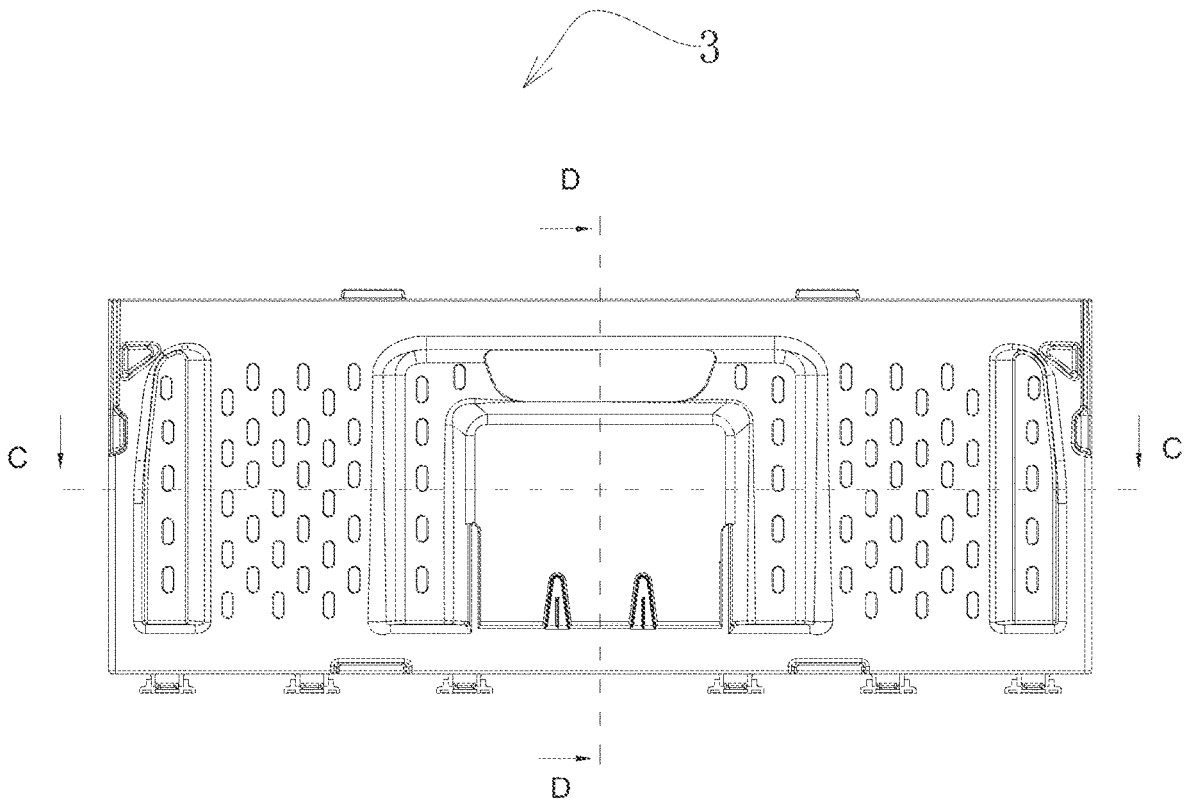
FIG. 10 is a front view of the long side plate of FIG. 9.
Figure 11:
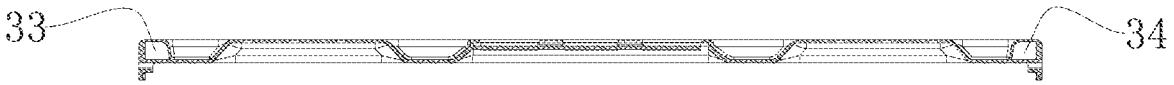
FIG. 11 is a cross-sectional view taken along line C-C of the long side plate of FIG. 10.
Figure 12:
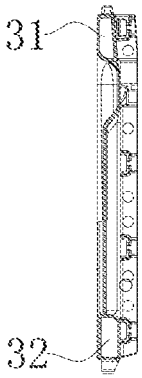
FIG. 12 is a cross-sectional view taken along line D-D of the long side plate of FIG. 10.

FIG. 9 is a perspective view of a long side plate of this embodiment, and FIG. 10 is a front view of the long side plate of FIG. 9, FIG. 11 is a cross-sectional view taken along the line C-C of the long side plate of FIG. 10, and FIG. 12 is a cross-sectional view taken along the line D-D of the long side plate of FIG. 10. As shown in FIGS. 9-12, similar to the short side plate 2, the upper edge of the long side plate 3 is provided with a cavity 31 formed in the length direction of the side plate, and the lower edge is provided with a cavity 32 formed in the length direction of the side plate, the left end part is provided with a cavity 33 formed in the height direction, and the right end part is provided with a cavity 34 formed in the height direction. Preferably, the cavities in the upper edge, the lower edge, the left end part, and the right end part are formed through air-assisted injection molding, preferably the cross sections of the cavities 31, 32, 33 and 34 are rectangular.

As shown in FIG. 9, a concave part 35 extending in the height direction is arranged adjacent to the left end on the outer side surface of the long side plate 3, and a concave part 36 extending in the height direction is arranged adjacent to the right end on the outer side surface of the long side plate 3. When the plurality of collapsible boxes 100 are stacked together, and a concave parts 35 and 36 on the adjacent long side plates 3 of the adjacent collapsible boxes form a cavity in the height direction of the side plate, and the cavity is used for supporting the base of the upper-layer collapsible box, so that the base of the upper-layer collapsible box is prevented from depressing, and the details will be further described below.

Preferably, cavities 23, 24 in the left end and right end on long side plate 3 are respectively arranged in the connecting parts 33A and 34A of the long side plate 3, and the concave parts 35, 36 are respectively arranged adjacent to the connecting parts 33A and 34A at the left end and the right end of the long side plate 2. The connecting portions 33A and 34A are respectively provided with the engaging structures 33A1 and 34A1. The engaging structures 33A1 and 34A1 of the long side plates can engage with the engaging structures 23A1 and 24A1 of the short side plates, so that the adjacent short and long side plates can be connected. Unlike the short side plates 2, on the long side plate 3, concave parts 37 and 38 are further provided between the concave parts 35, 36. Preferably, the concave parts 35, 36, 37 and 38 are uniformly spaced apart. The connecting portion 33A and the connecting portion 34A are used for being connected with adjacent short side plates. Although in this example, two concave parts are provided between the concave parts 35 and 36 of a long side plate 3, those skilled in the art can understand that, between the concave parts 35 and 36, one or more concave parts can further be arranged.

Preferably, the height range of the concave parts 35, 36 is 0.1 to 0.9 times of the height of the side plates 2, and the depth range of the concave parts 35, 36 in the thickness direction of the short side plate 2 is 0.1-0.9 times of the thickness of the side plate 2.

As shown in FIG. 9, a plurality of vents 30 are formed in the long side plate 3, and the vents 30 are distributed in the area enclosed by the cavity 31 formed in the length direction of the long side plate and the cavity 33 and 34 formed in the height direction, and a plurality of vents 30 are also formed in the concave parts 35, 36, 37, and 38.

In this embodiment, due to the fact that the long side plates and the short side plates are formed by air-assisted process, so that the peripheral outer edges of the side plates are hollow, in order to reinforce the side plates. The four air-assisted cavities in the outer edge are in a rectangular shape and joined with each other, so not only the compression-resistance and bending resistance (the vertical air-assisted cavities in the two sides) of the side plate in multi-layer stacking process are enhanced, but also the outwards deformation resistance of the side plates when subjecting to the extrusion of the goods (air-assisted cavities in upper and lower edge) is also enhanced. Further, the two sides of the side plate are smooth and easy to clean.

As a variant of this embodiment, in cavities 21, 22, 23 and 24, the reinforcing material can be further provided or the filler can be filled to enhance the strength of the side plates.

Figure 13:
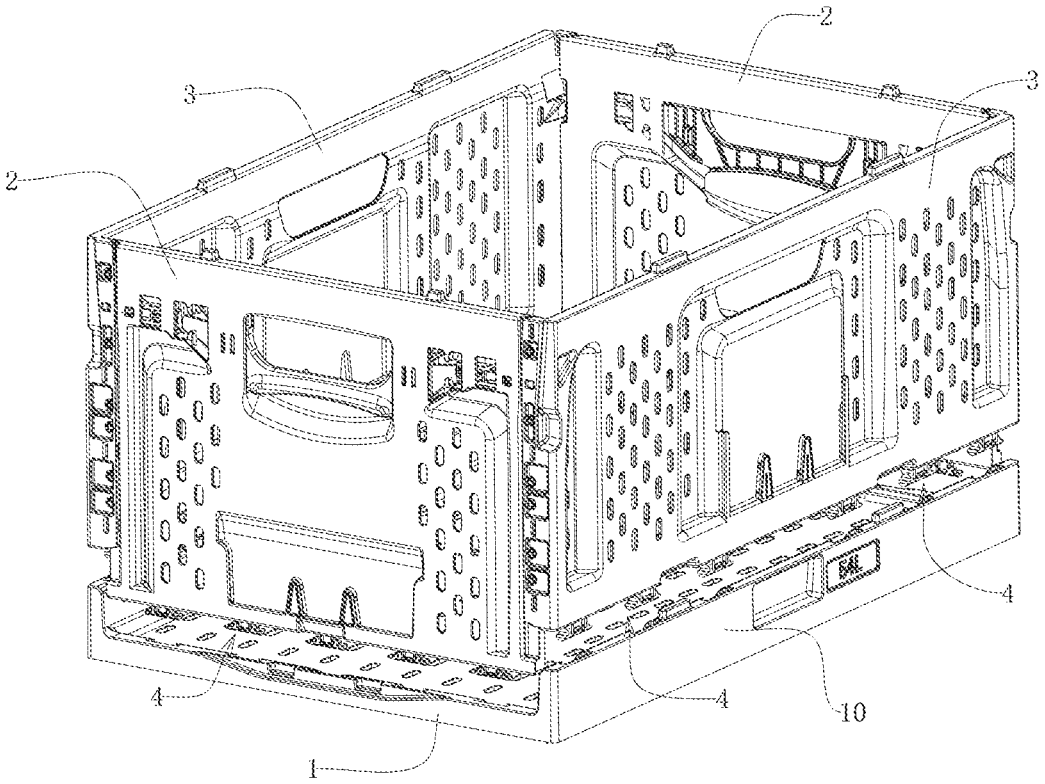
FIG. 13 is another perspective view of the collapsible box of this invention, with the side plate in erected state.

FIG. 13 is another perspective view of the collapsible box of this invention, with the side plate in erected state. As shown in FIG. 13, through the long and short side plates formed by air-assisted process, the side plates are reinforced by a rectangular frame work presented by themselves, so that the torsion resistance and the deformation resistance are improved. When the base bears heavy goods, the flat base will generally depress, then, the protruded portion on the long edge of the base will incline toward inside of the base, and the long side edge of the base will bed is placed towards the center of the box. Since the base is hinged to the side plate through hinges, when the base moves inwards, the lower edge of the side plate can be correspondingly dragged by the base so that the middle part of the side plate will deform by bending towards the inside of the box body, so that the lower end of the side plate formed by the air-assisted process which is rectangular in cross section has better bending resistance than the reinforcing ribs arranged on the thin wall plate.

Figure 14:
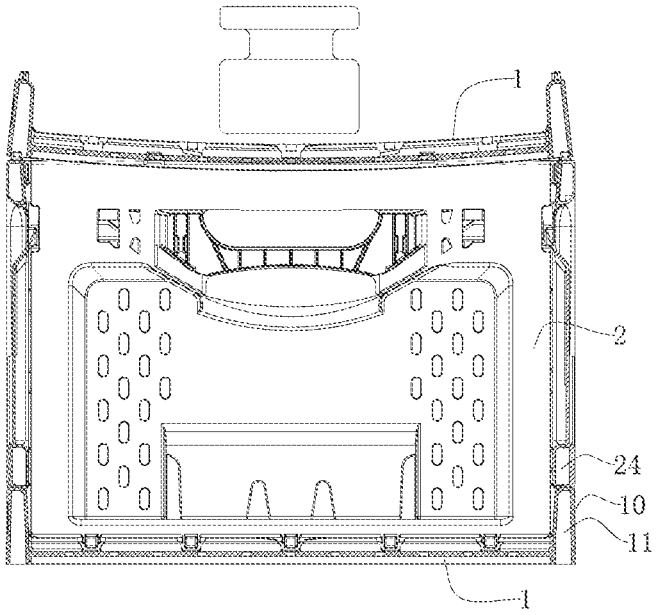
Figure 15:
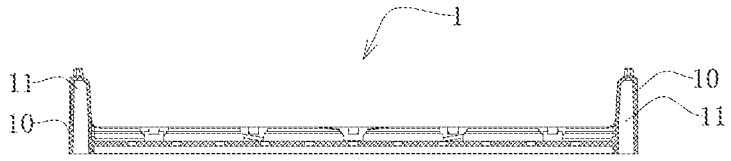
Figure 16:
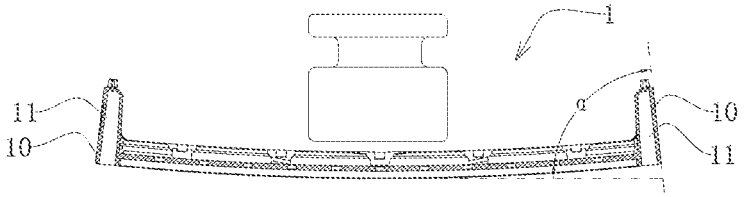

FIGS. 14-16 show the form where the base can deform easily during stacking of the collapsible boxes of this invention. A cavity 11 is formed in the protrusion edge 10 on the base 1 along the length direction thereof. FIG. 14 shows a cross-sectional view of the collapsible box when pressed, FIG. 15 is a cross-sectional view of the base 1 before deformation; and FIG. 16 is a cross-sectional view of the base 1 after deformation. As shown in FIGS. 14-16, when the multi-layer collapsible boxes are stacking, the base of the upper collapsible box depresses after being pressed, the protrusion edges of the base displace toward the center part of the side plate (the included angle $\alpha$ between the protrusion edge and the base is reduced), wherein the safety risky of collision of the upper-layer goods and the lower-layer goods is caused by depressing of the base.

Figure 17:
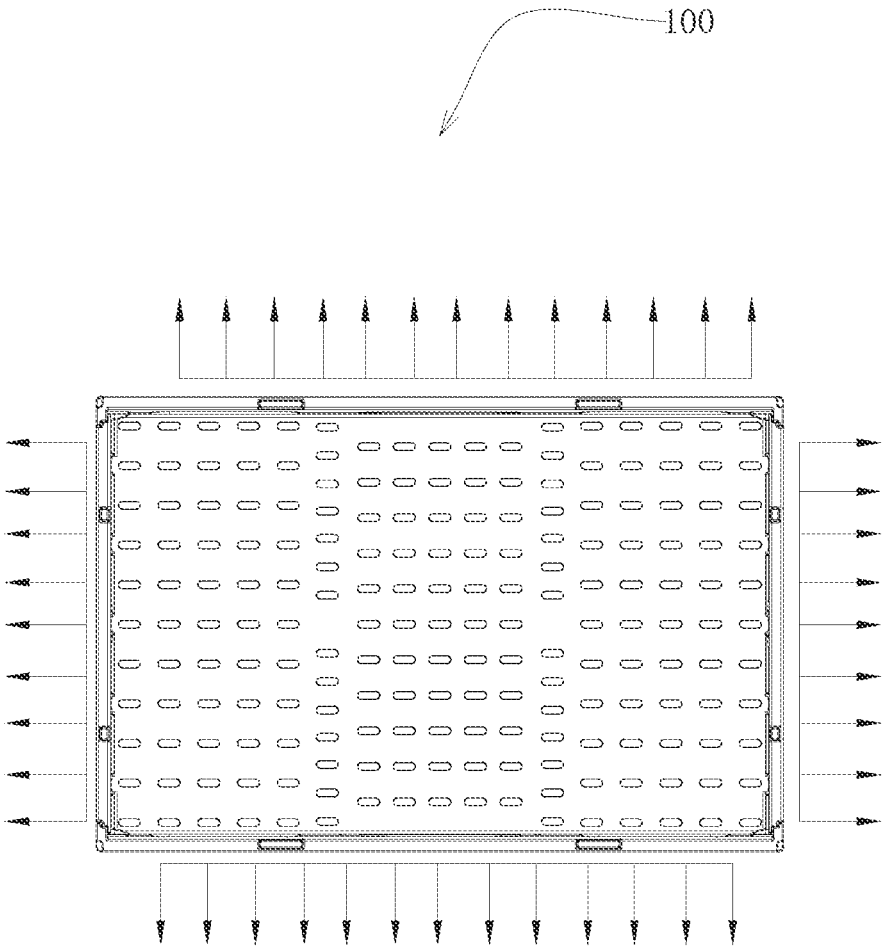
Figure 18:
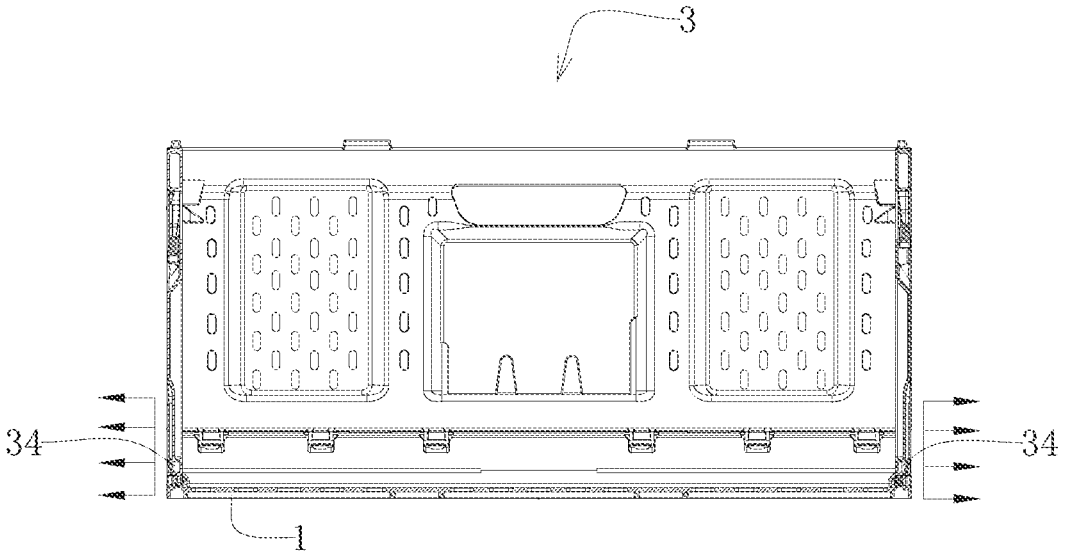
Figure 19:
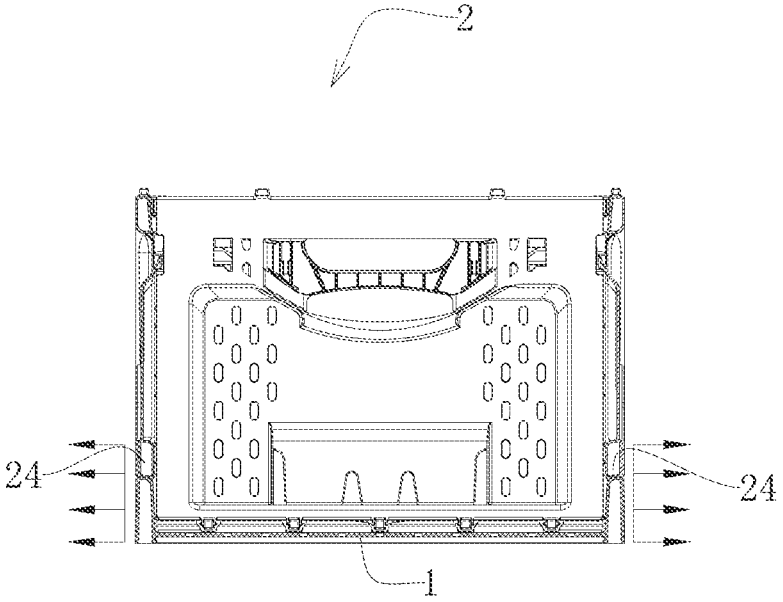

FIGS. 17-19 show stress states of each side plate of the collapsible box of this invention, wherein FIG. 17 is the top view, FIG. 18 is the cross-sectional view, and FIG. 19 is another cross-sectional view. As shown in FIGS. 17-19, due to the fact that the air-assisted cavity is formed in the protrusion edge of the base of the collapsible box, when the multilayer collapsible boxes are stacking, after the base of the upper collapsible box is pressed, when the base depressed so that the protrusion edges displace toward the center of the side plate, the air-assisted cavity provides reverse support to the protrusion edge, so that the inward inclining phenomenon of the base protrusion edge is avoided.

Figure 3:
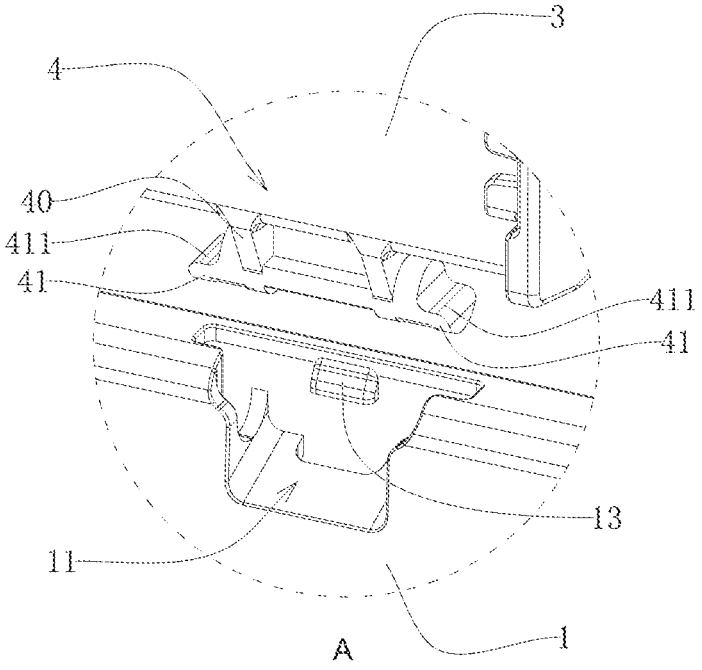
FIG. 3 is an enlarged view of part A of FIG. 2.
Figure 4:
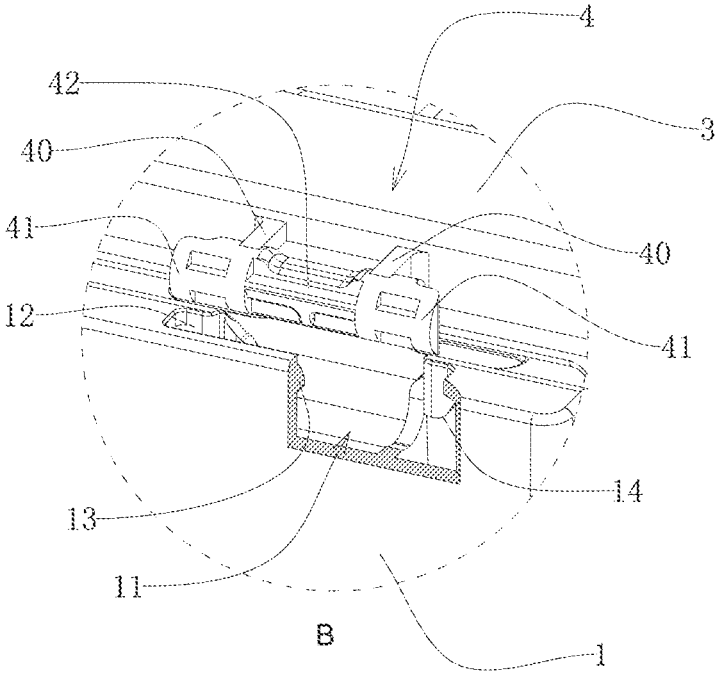
FIG. 4 is an enlarged view of part B of FIG. 2.

Now turning to FIGS. 2-4, FIG. 3 is an enlarged view of part A of FIG. 2, and FIG. 4 is an enlarged view of the part B of FIG. 2. A pair of long side plates 3 and a pair of short side plates 2 of the collapsable box 100 are connected with the base 1 by hinges 4. The condition of the short side plate is same as that of the long side plate, so that only the long side plate is taken as an example for description. As shown in FIGS. 3-4, a hinge seat 40 is arranged on the lower side of the lower edge of the long side plate 3, hinge pins 41 are arranged at the two ends of the hinge seat 40, and a hanging shoulder 42 is arranged in the middle of the hinge base sea 40. A hinge groove 11 is formed in the base 1, hinge pin mounting grooves 12 for containing hinge pins are formed in the two ends of the hinge groove 11, a first limiting boss 13 is arranged on the inner side wall of the hinge groove 11, and a second limiting boss 14 is arranged at the position close to the middle point of the two ends of the hinge groove 11. The hanging shoulder 42 on the hinge seat 40 is engageable with the first limiting boss 13, the hinge pins 41 are engageable with the second limiting boss 14. Specifically, a third limiting boss 411 is arranged at the end of the hinge pin 41, and the contour surface of the third limiting boss 411 is engageable with the second limiting boss 14.

When the long side plate 3 is in folded state, the hinge pin 41 is installed downwards along the hinge groove 11, and the first limiting boss 13 is deformed outwards, after the hinge pin 41 is installed in place, the first limiting boss 13 is restored and buckled on the hanging shoulder 42 so as to prevent the long side plate 3 from being separated from the base 1. When the long side plate 3 is erected, the side face of the hinge pin 41 contacts with the second limiting boss 14, so as to prevent the long side plate 3 from moving upwards.

Compared with ordinary prior hinges, the hinge pin 41 of the hinge 4 is formed by directly machining two ends of the hinge seat, and the diameter of the hinge pin 41 is larger than that of the common hinge, so the mechanical property is excellent. Further, when combining with the reinforcing structure (such as the cavities and reinforcing ribs in the above embodiment) on the long side plate and short side plate, the inward tilting of the protrusion edge of the base can be further prevented. So, the base of the box is not easy to depress, the further deformation of the side plate caused by the inward tilting of the protrusion edge of the base can be solved. The box body can be repeatedly used, so the service life of the box is prolonged.

Figure 20:
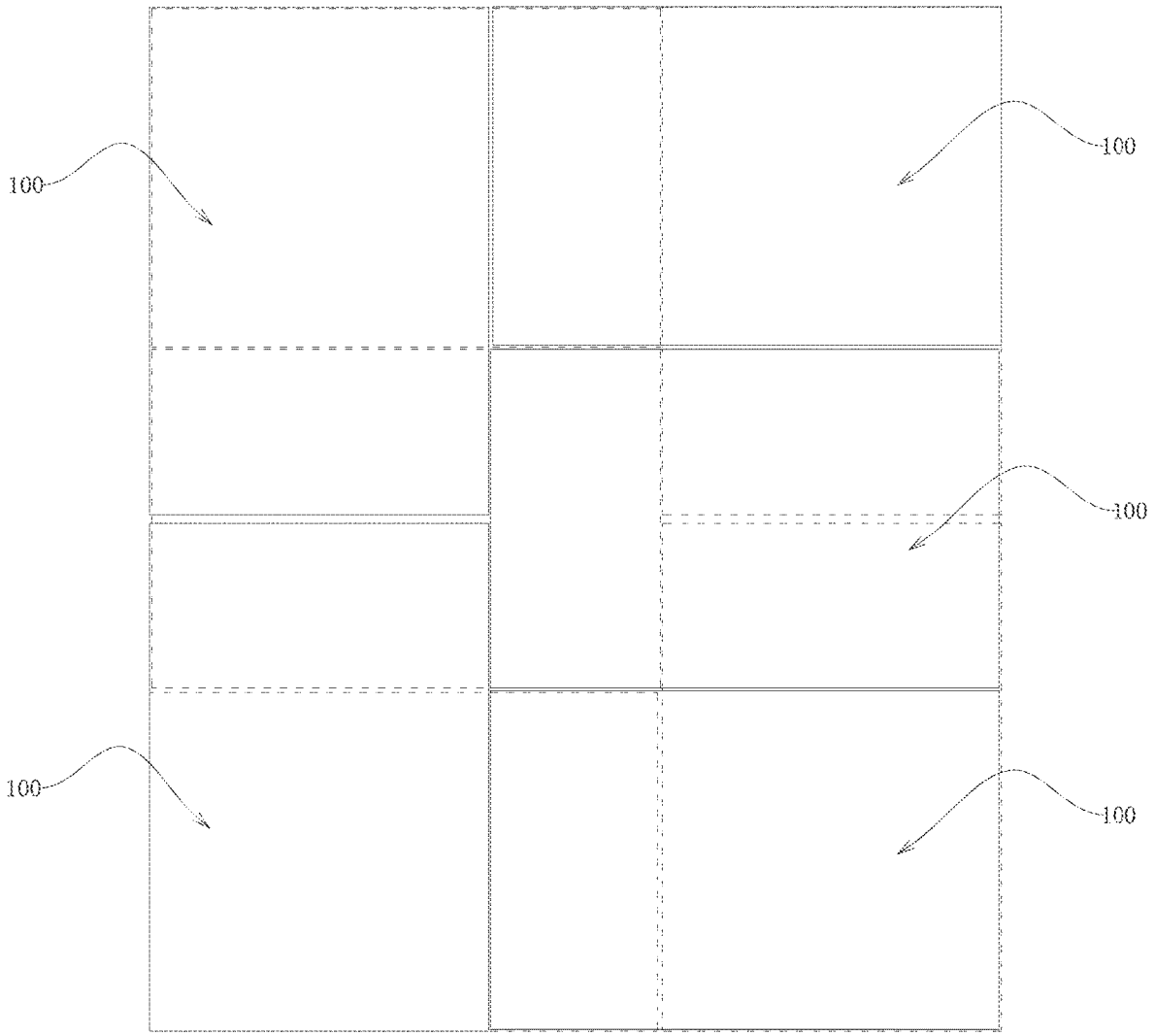
FIG. 20 shows a state of a plurality of collapsible boxes stacked into two layers, wherein the dotted lines show the lower-layer collapsible boxes, and the solid lines show the upper-layer collapsible boxes.

FIGS. 20-30 illustrate the state in which a plurality of collapsible boxes of this invention are stacked together. FIG. 20 shows the state in which a plurality of collapsible boxes 100 are stacked into two layers, wherein the solid line represents the collapsible box of the upper layer, and the collapsible box of the lower layer is represented by the dotted lines. According to a preferred embodiment, the length-width ratio of the collapsible box 100 of this invention is 3:2, as shown in FIG. 20. So, when in the lower layer, three collapsible boxes are transversely placed along the left side, and two collapsible boxes are placed vertically along the right side, a rectangle can be formed, as shown by the shape enclosed by the dotted lines. Then, as the solid lines shown in FIG. 20, the arrangement of the collapsible boxes of upper layer is mirrored from that of the lower layer, that is, two collapsible boxes are vertically placed along the left side, and three collapsible boxes are placed transversely along the right side, so a rectangle of the same size to that in the lower layer can be formed.

Figure 21:
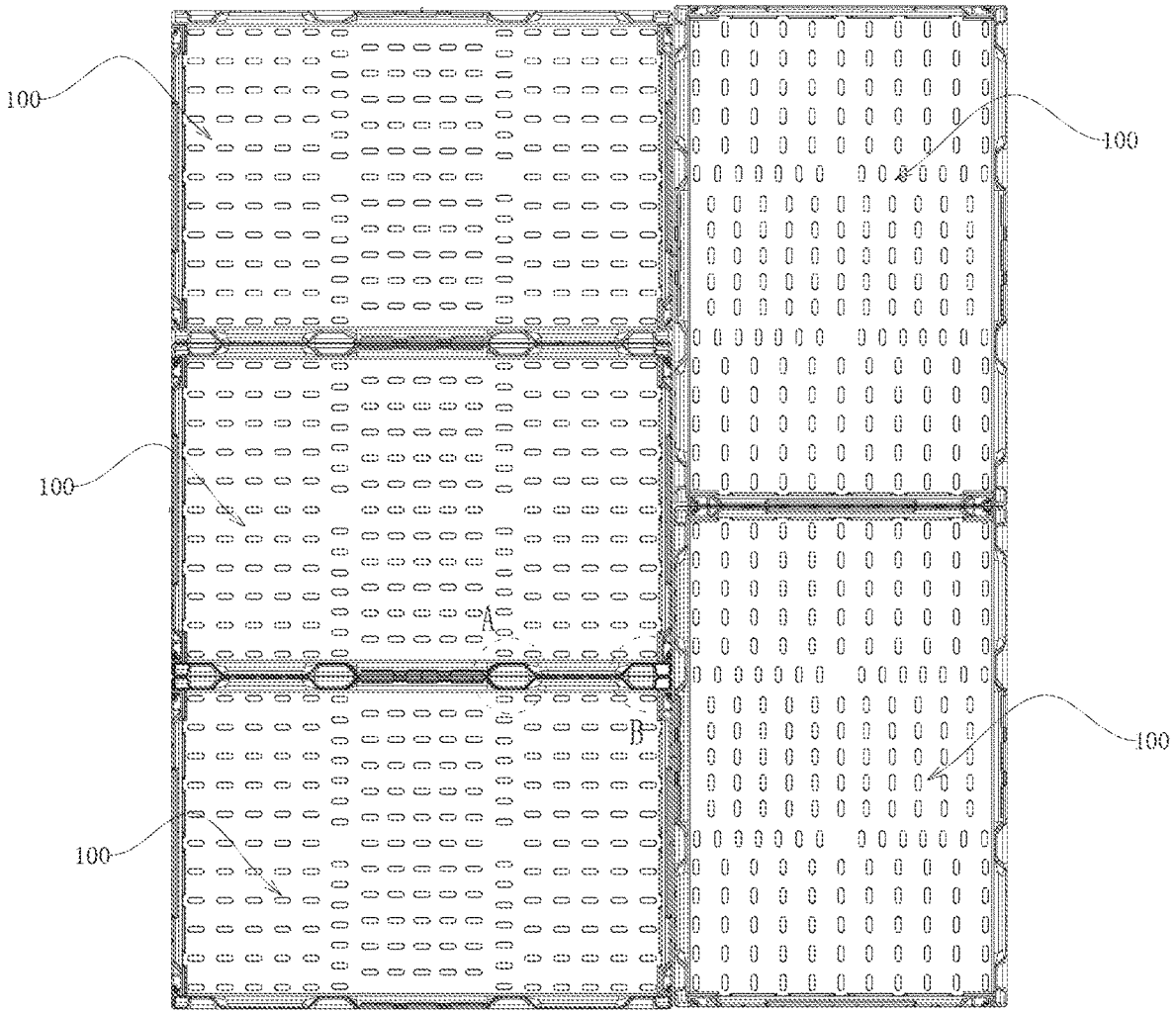
FIG. 21 shows a cross-sectional view of the lower-layer collapsible box of FIG. 20.
Figure 22:
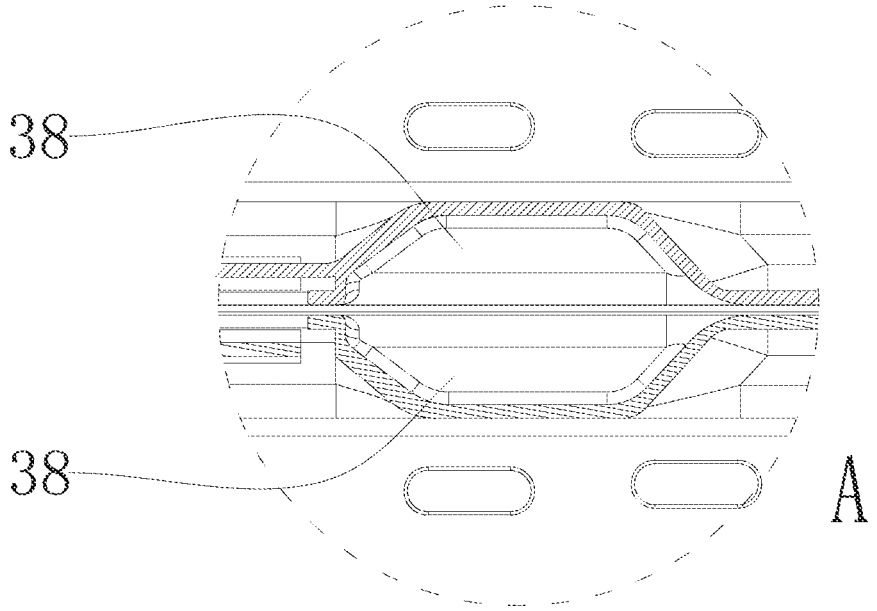
FIG. 22 is an enlarged view of part A of FIG. 21.
Figure 23:
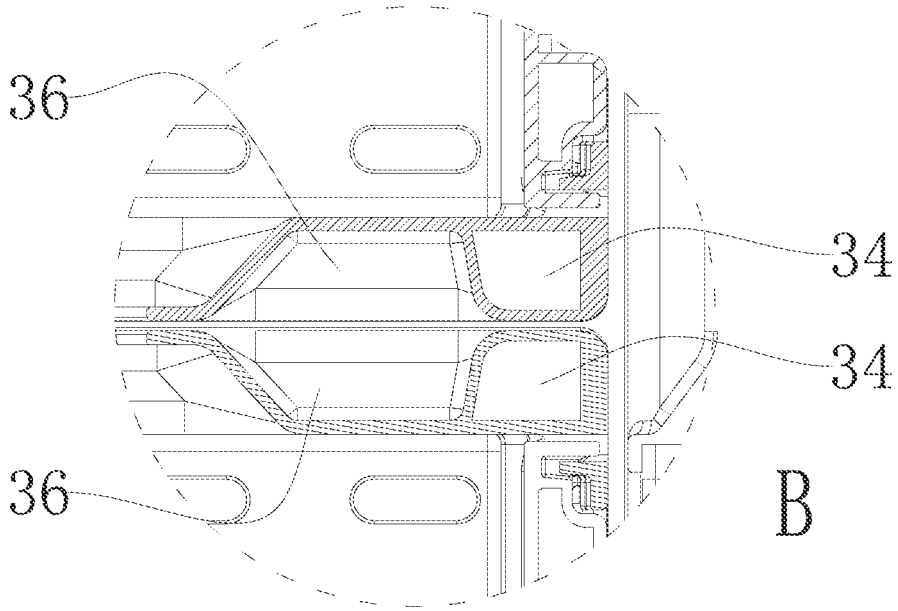
FIG. 23 is an enlarged view of part B of FIG. 21.

FIG. 21 shows the cross section of collapsible boxes in the lower layer of FIG. 20 (i.e. the collapsible box shown by the dotted line), and FIG. 22 is an enlarged view of the part A in FIG. 21, FIG. 23 is an enlarged view of the part B in FIG. 21.

As shown in FIG. 21, when a plurality of collapsible boxes 100 are stacked together, the concave parts on the long side plates of the two adjacent collapsible boxes align with each other to form a cavity in the height direction of the side plate. As shown in FIG. 22, the concave part 38 on the long side plate 3 of one collapsible box and the corresponding concave part 38 on the long side plate 3 of another collapsible box cooperate to form a cavity 380 along the height direction of the side plate. As shown in FIG. 20, due to the fact that the upper layer of collapsible boxes and the lower layer of collapsible boxes are arranged staggeredly, the cavity 380 along the height direction of the side plates forms a powerful support for the base of the upper layer of collapsible box, so as to prevent the base of the upper-layer collapsible box from depressing.

Figure 24:
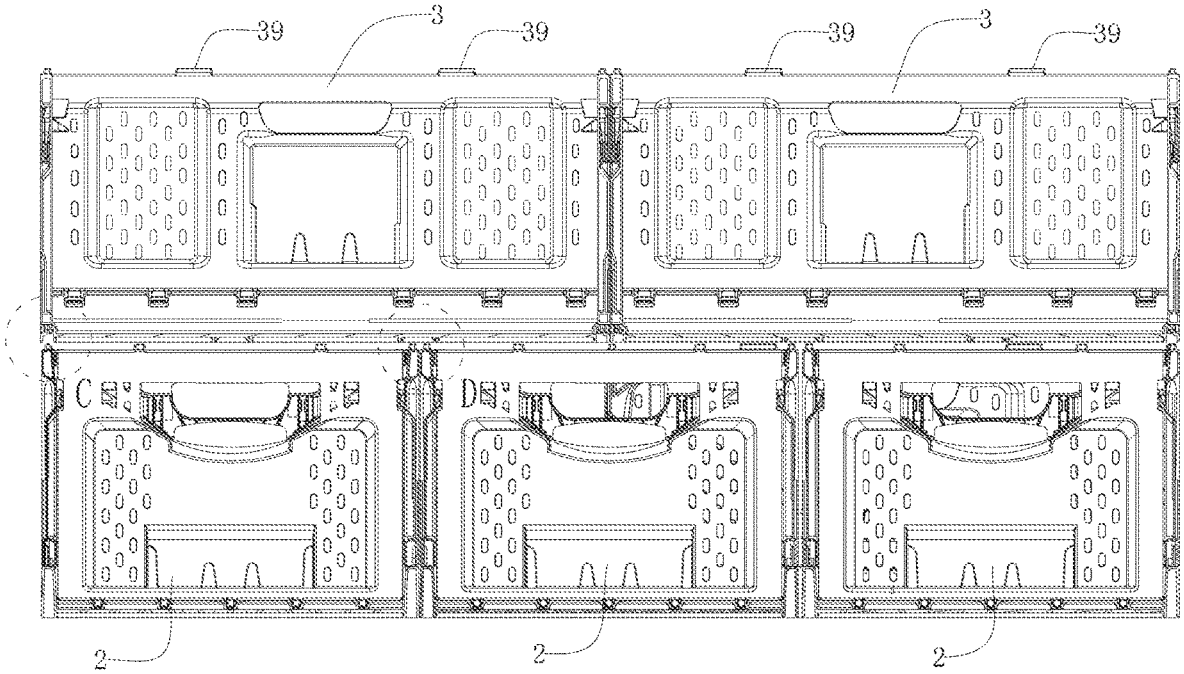
FIG. 24 shows a cross-sectional view of the collapsible box of FIG. 20.
Figure 25:
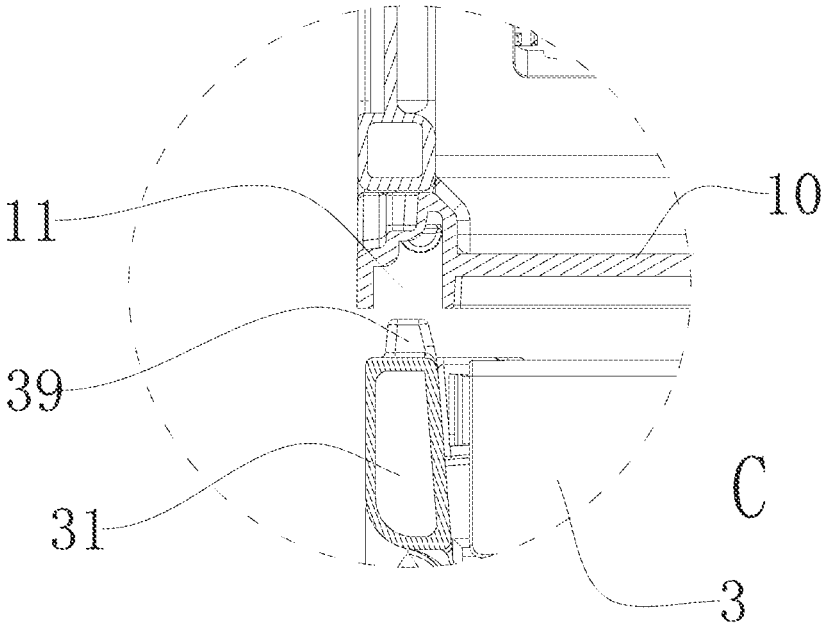
FIG. 25 is an enlarged view of part C of FIG. 24.
Figure 26:
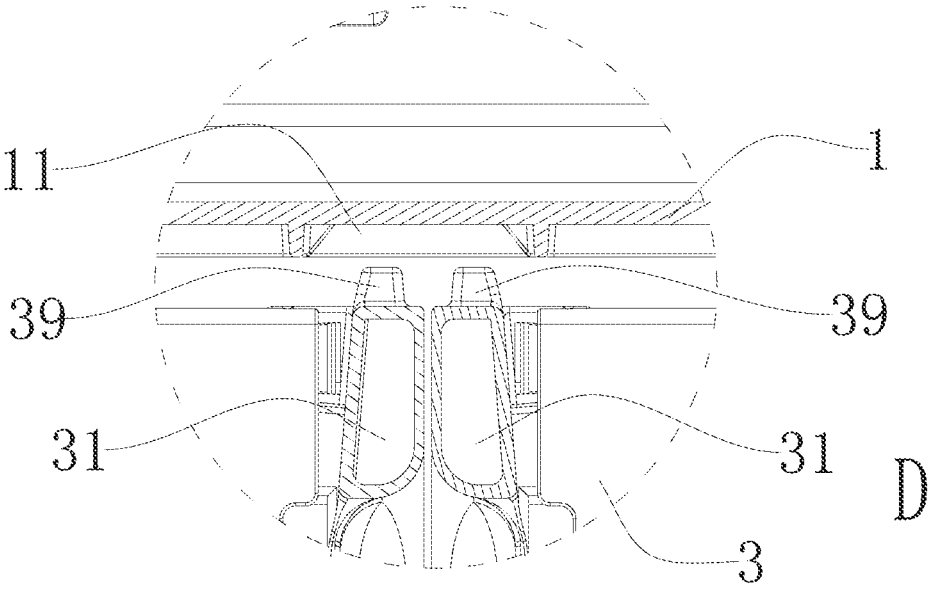
FIG. 26 is an enlarged view of part D of FIG. 24.

FIG. 24 is a cross-sectional view of the collapsible box of FIG. 20, FIG. 25 is an enlarged view of the part C of FIG. 24, and FIG. 26 is an enlarged view of the part D of FIG. 24.

As shown in FIGS. 24-26, when the collapsible boxes 100 are stacked into two layers, the protrusions 21 on the short side plate 2 and the protrusions 31 on the long side plate 3 of the lower layer of collapsible box are inserted into the corresponding pockets 11 in the base of the upper layer of collapsible box respectively, so that the upper-layer collapsible box and the lower-layer collapsible box can be effectively positioned relative to each other, and the mutual sliding of the upper-layer collapsible box and the lower-layer collapsible box is prevented.

Figure 27:
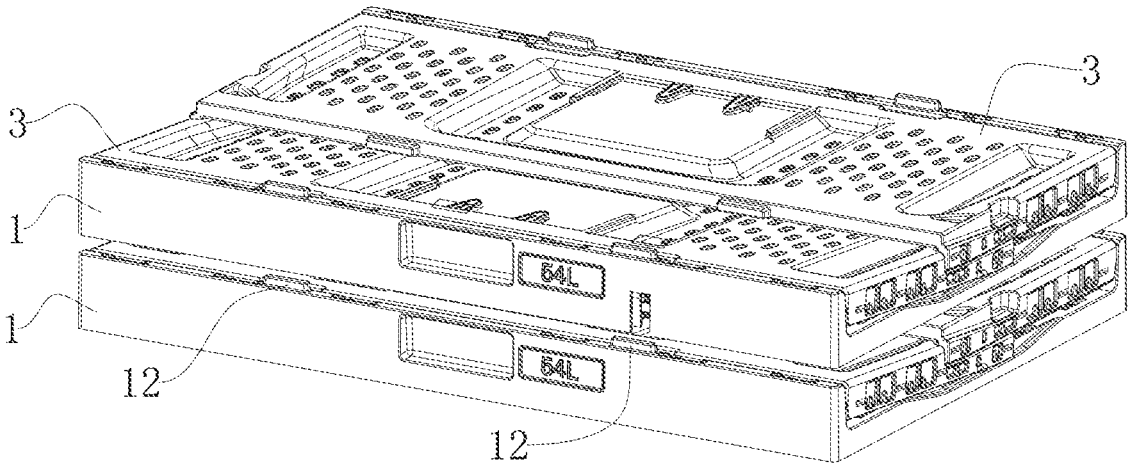
FIGS. 27-28 show the state when two collapsible boxes in collapsed state are stacked together.
Figure 28:
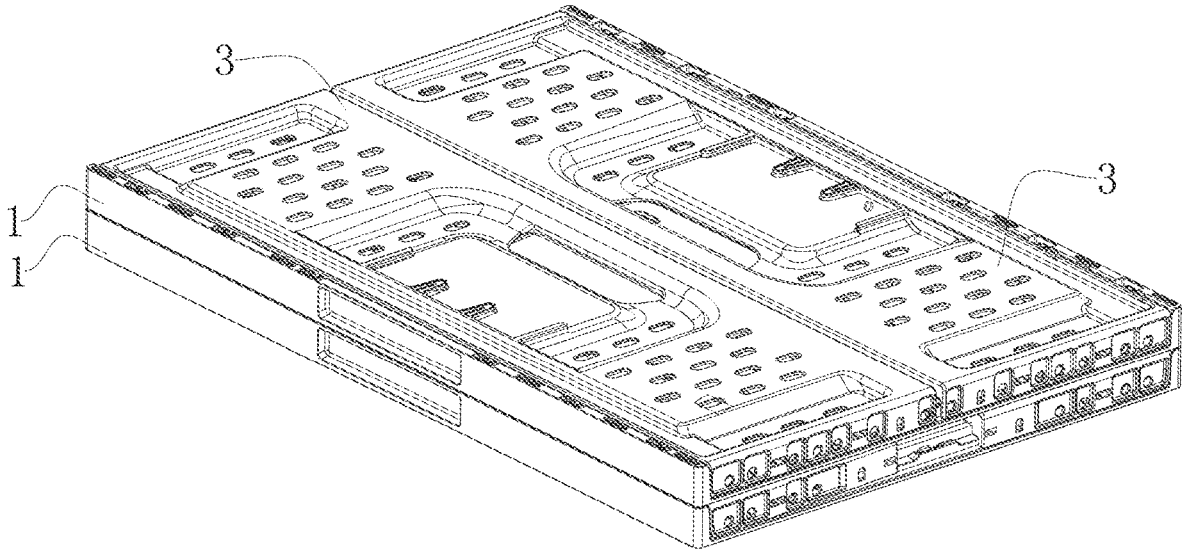
Figure 29:
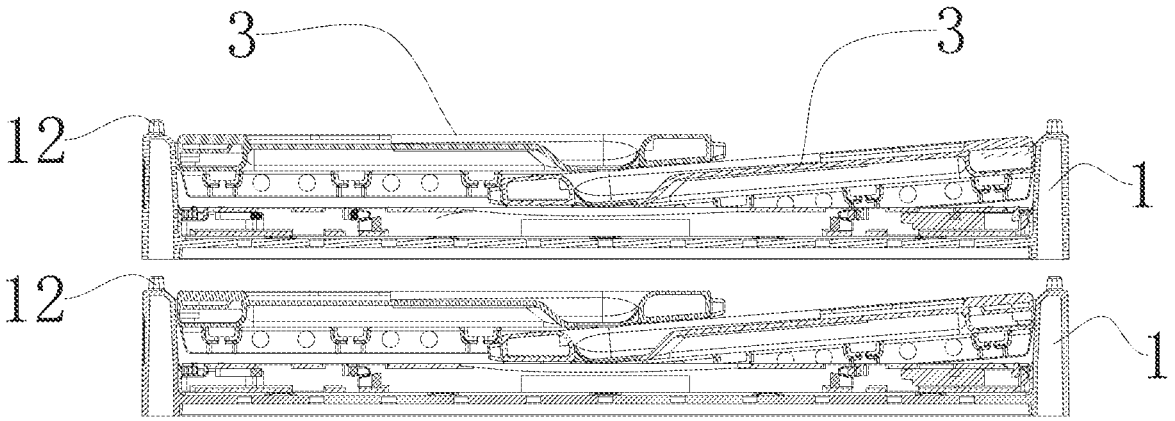
FIG. 29 is a cross-sectional view of the collapsible box of FIG. 27.

FIGS. 27-28 illustrate the state when two collapsible boxes in deployed state are stacked together, FIG. 29 is a cross-sectional view of the collapsible boxes of FIG. 27. As shown in FIGS. 27-29, a second protrusion 12 is arranged on the base 1 of the collapsible box, when the two collapsible boxes in a folded state are stacked together, the protrusions on the side plates of the lower-layer collapsible box are clamped into the pocket 11 in the base of the upper layer collapsible box, so that the collapsible boxes in the upper layer and the lower layer can be positioned together, so that the collapsible boxes of the upper layer and the lower layer are not easy to slide relative to each other.

Therefore, the pocket 11 and the second protrusion 12 engageable with the pocket 11 are formed in the base of the collapsible box, and protrusions 27 and 37 engageable with the pockets 11 are arranged on the long side plate and the short side plate of the collapsible box respectively, so that whether the collapsible box is in the deployed state or the collapsed state, the upper layer collapsible box and the lower layer collapsible box are mutually positioned and fixed, so that the upper layer collapsible box and the lower layer collapsible box can be movably fixed together.

Figure 30:
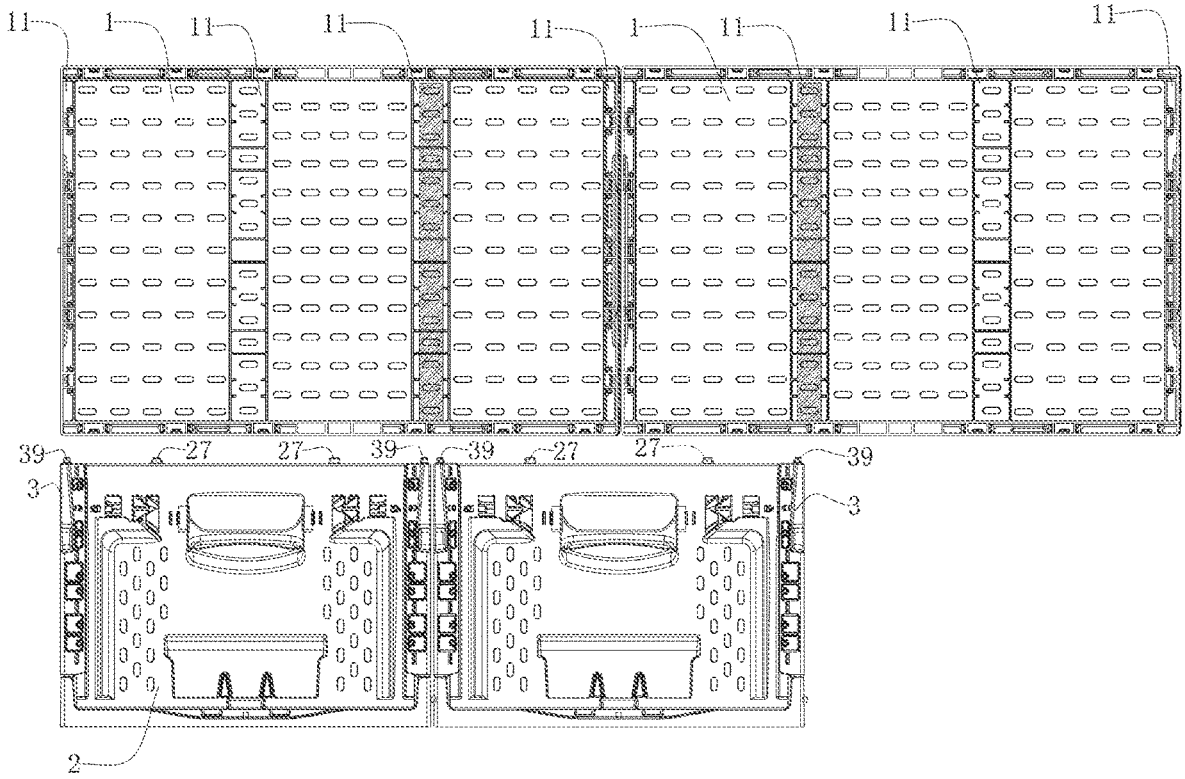
FIG. 30 shows a schematic diagram of engaging states between protrusions on a side plate of a lower-layer collapsible box and pockets on a base of an upper-layer collapsible box when two layers of collapsible boxes are stacked together.

FIG. 30 is an engaging schematic diagram of protrusions on the side plate of the lower-layer collapsible box and pockets on the base of the upper-layer collapsible box when two layers of collapsible boxes are stacked together. As shown in FIG. 30, the bottom surface of a base 1 of the collapsible box is provided with four rows of pockets 11 arranged at equal intervals in the width direction of the base. So, when the multi-layer collapsible boxes are stacked together, and the protrusions on the side plates of the lower-layer collapsible box are inserted into the pockets 11 in the base 1 of the upper-layer collapsible box, so that the upper layer and the lower layer are mutually fixed.

Figure 31:
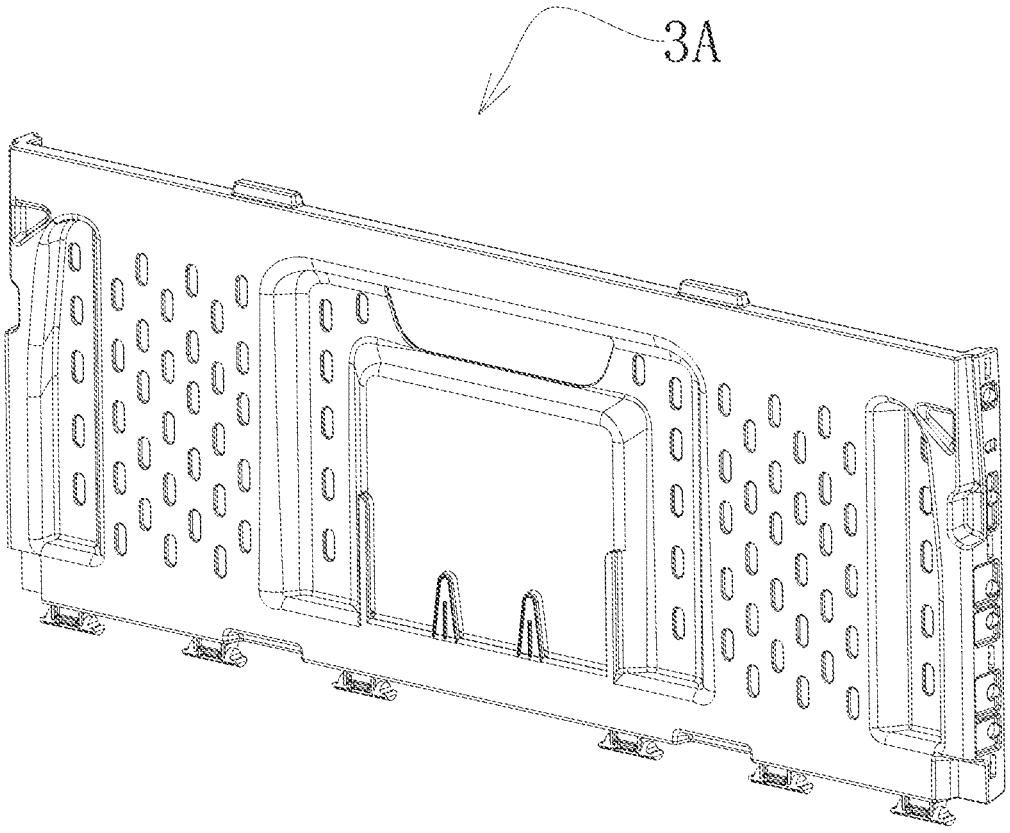
FIG. 31 is a perspective view of a long side plate according to another embodiment of this invention.
Figure 32:
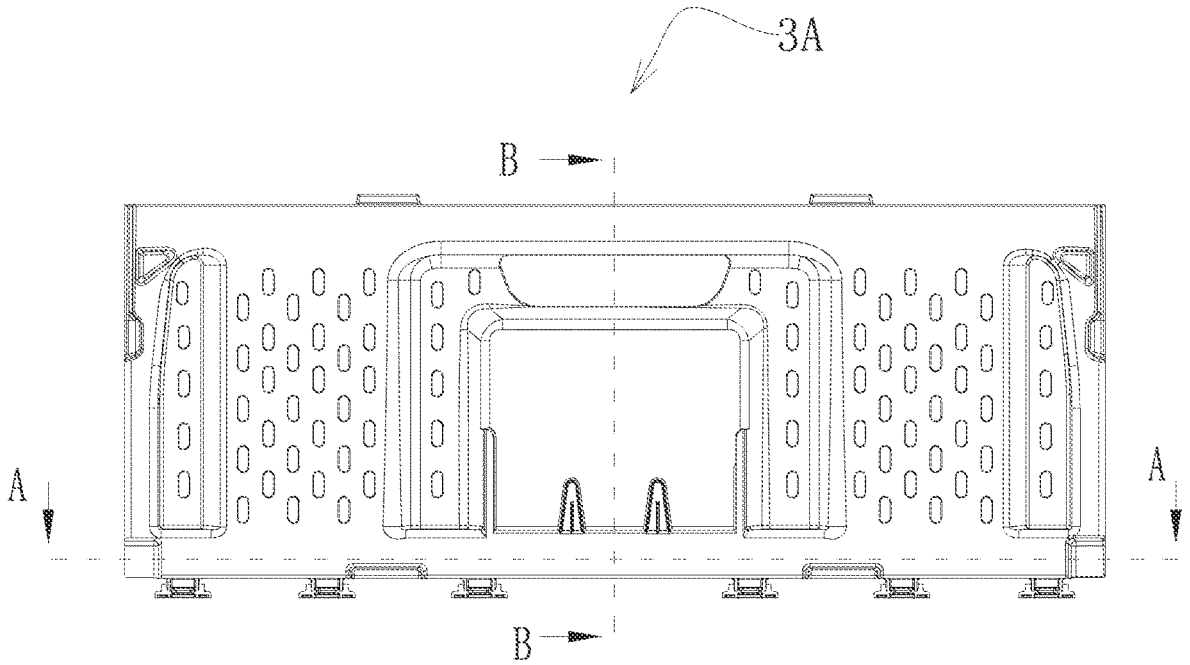
FIG. 32 is a front view of the long side panel of FIG. 31.
Figure 33:
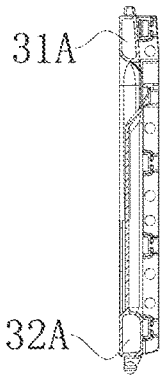
FIG. 33 is a cross-sectional view taken along line B-B in FIG. 32.
Figure 34:
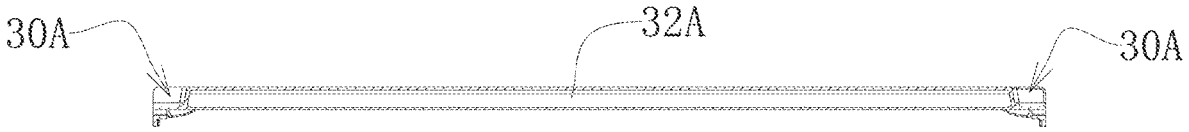
FIG. 34 is a cross-sectional view taken along line A-A in FIG. 32.

Another embodiment of this invention is described below with reference to FIGS. 31-34. FIG. 31 is a perspective view of a long side plate according to another embodiment of this invention, FIG. 32 is a front view of the long side plate of FIG. 31; FIG. 33 is a cross-sectional view taken along line A-A in FIG. 32, and FIG. 34 is a cross-sectional view taken along line B-Bin FIG. 32. As shown in FIGS. 31-34, the difference between the present embodiment and the former embodiment is that, the upper edge and the lower edge of the long side plate 3A are provided with a cavity 31A and a cavity 32A extending in the length direction of the side plate respectively, and cavities (not shown) extending along the height direction of the side plate are formed in the left and right end parts of the long side plate 3A. The cavity 31A in the upper edge of the long side plate 3A is in fluid communication with the cavities in the left end part and the cavity in the right end part. The cavity 32A in the lower edge of the long side plate 3A is separated from the cavities in the left end and the cavity of the right end. As shown in FIG. 33, in the embodiment, the cavity 32A in the lower edge of the long side plate 3A is separated from the cavities in the left and right end parts of the long side plate 3A by the corner part 30A. Regarding other details not described in this embodiment, please refer to the former embodiment.

Figure 35:
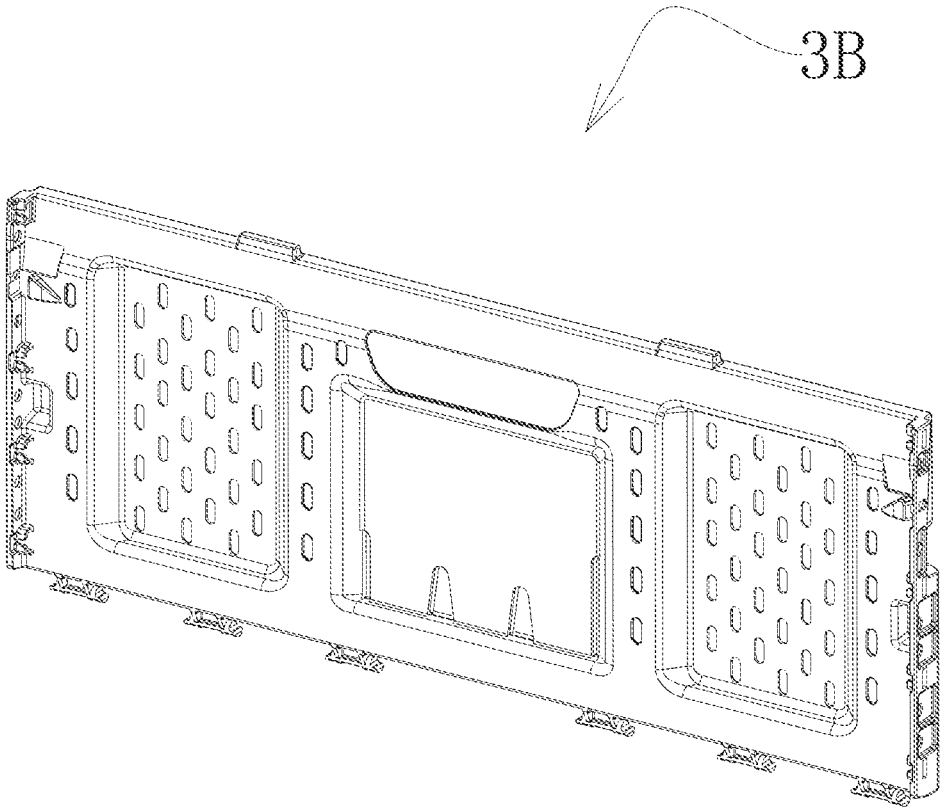
FIG. 35 is a perspective view of the long side plate according to another embodiment of this invention.
Figure 36:
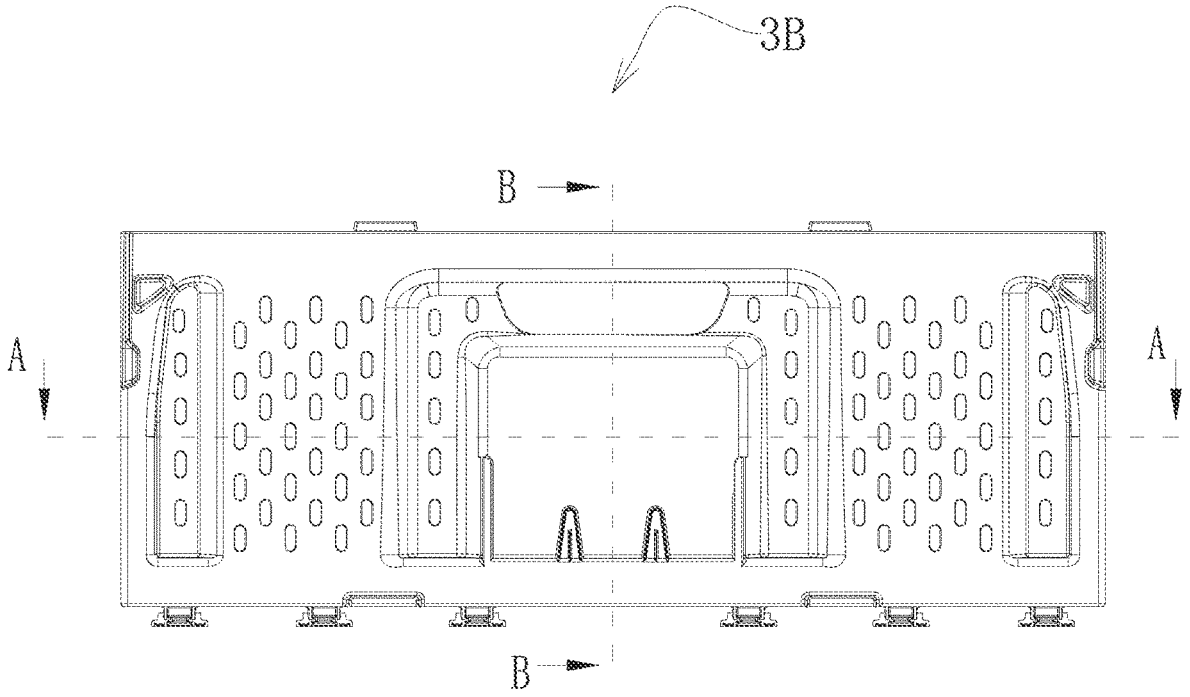
FIG. 36 is the front view of the long side plate of FIG. 35.
Figure 37:
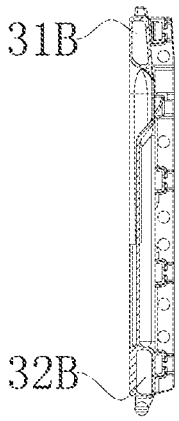
FIG. 37 is the cross-sectional view taken along line B-B in FIG. 36.
Figure 38:
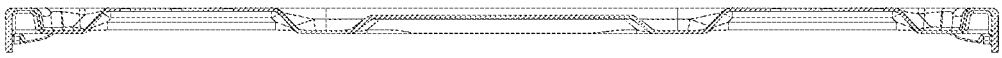
FIG. 38 is the cross-sectional view taken along line A-A in FIG. 36.

Another embodiment of this invention is described below with reference to FIGS. 35-38. FIG. 35 is a perspective view of a long side plate according to another embodiment of this invention, FIG. 36 is a front view of the long side plate of FIG. 35, FIG. 37 is a cross-sectional view taken along line A-A in FIG. 35, and FIG. 38 is a cross-sectional view taken along line B-B in FIG. 35. As shown in FIGS. 35-38, this invention differs from the previous embodiment in that in this embodiment, cavities 31B and 32B extending along the length direction of the side plate are provided in the upper edge and lower edge of the long side plate 3B respectively, cavities (not shown) extending along the height direction of the side plates are provided in the left end part and right end part of the long side plates 3B respectively, and the cavity 31B in the upper edge of the long side plate 3B is in fluid communication with the cavities in the left and right end parts, and the cavity 32B in the lower edge of the long side plate 3B is in fluid communication with the cavities in the left and right end parts. However, as shown in FIG. 37, in this embodiment, the cavities in the left and right end parts of the long side plate 3B is divided at the middle of the long side plate 3B. That is, in this embodiment, the cavities in the left and right end parts of the long side plates 3B include an upper cavity and a lower cavity separated from each other, the upper cavity and the lower cavity in the left and right end parts of the long side plate can also be divided at other positions of the long side plate, for example, at the ¼ height of the long side plate 3B, at the ¾ height of the long side plate 3B, and the like. Regarding other details not described in the embodiment, please refer to the former embodiment.

In this invention, the lower edge of the side plate is provided with a cavity extending along the length direction of the side plate, so that when each side plate is in erected state, the lower edge of the side plate provided with the cavity and the lower edge of the side plate which provided with the cavity are connected with each other to form a frame, the frame is hinged to the base through hinges (namely, the lower edges of the side plates are hinged to the base through hinges), so as to form a reinforcing structure capable of resisting the depressing of the base and the inward inclining of the protrusion edge.

In addition, due to the fact that the side plates of the collapsible box in this invention are dual-smooth side plates, the problem of dirt remained after cleaning during repeated use of the collapsible box can be maximally reduced, the cleaning efficiency is improved, the depressing of the base after the box is loaded is alleviated, and the problem that goods are damaged due to mutual collision between goods in upper and lower layers due to the fact that the base is depressed when a multiple layers of collapsible boxes are stacked is avoided.

The preferred embodiments of this invention have been described in detail above, however, it should be understood that after reading the teachings of this invention, the skilled one in this art can make various modifications or modifications of the invention. These equivalent forms are also within the scope defined by the appended claims.

The invention claimed is:

1. A collapsible box, comprising a base and two pairs of opposite side plates, and protrusion edges are arranged on the periphery of the base, wherein the side plates are hinged to the base and foldable relative to the base, wherein each of the side plates is a dual-smooth side plate, and at least one pair of the side plates are each provided with a closed cavity in a lower edge, wherein the closed cavity is located between an inner side surface and an outer side surface of the side plate, and when the collapsible box is deployed, the lower edges of one pair of side plates of the two pairs of opposite side plates are connected with the lower edges of the other pair of side plates to form a frame, and the frame is hinged to the base through hinges, so as to form a reinforcing member which resists the base from depressing and the protrusion edge from recessing, wherein the hinges are provided at the bottom of the lower edge of the side plate, wherein the hinges each comprise a hinge seat provided on the lower side of the lower edge of the side plate, and a hinge groove provided at the base, the hinge groove engageable with the hinge seat, and wherein the hinge seat includes at least two hinge pins.

2. The collapsible box according to claim 1, wherein a closed cavity extending along the length direction of the side plate is formed in the upper edge and/or the lower edge of each side plate, so that when the two pairs of opposite side plates are in erected state, and the closed cavities in the upper edges of the two pairs of opposite side plates form a rectangular frame, and/or the closed cavities in the lower edges of the two pairs of opposite side plates form a rectangular frame.

3. The collapsible box according to claim 1, wherein a closed cavity extending along the length direction of the side plate is provided in the upper edge of the side plate, and the left end part or the right end part of the side plate is provided with a closed cavity extending along the height direction of the side plate.

4. The collapsible box according to claim 1, wherein a closed cavity extending along the length direction of the side plate is provided in the upper edge of the side plate, and closed cavities extending in the height of the side plate are provided in the left and right end parts of the side plate respectively, wherein the closed cavity formed in the upper edge of the side plate is in fluid communication with the closed cavities formed in the left and right end parts of the side plate, and the closed cavity formed in the lower edge of the side plate is spaced from the closed cavity formed in the left and right end parts of the side plate.

5. The collapsible box according to claim 3, wherein the closed cavity formed in the lower edge of the side plate and the closed cavity formed in the left and the end parts of the side plate are separated from each other at the lower left corner and the lower right corner of the side plate respectively.

6. The collapsible box according to claim 1, wherein a closed cavity extending along the length direction of the side plate is formed in the upper edge of the side plate, and closed cavities extending along the height direction of the side plate are provided in the left and right end parts of the side plate respectively, the closed cavities in the left and right end parts of the side plate comprise an upper closed cavity and a lower closed cavity spaced apart along the height direction of the side plate.

7. The collapsible box according to claim 1, wherein the closed cavity is a gas-assisted molding cavity.

8. The collapsible box according to claim 6, wherein the closed cavities of the left and right ends of the side plates extend from the upper edge to the lower edge of the side plate in the height direction, or extends downwards from the upper edge of the side plate for a predetermined length, or extends upwards from the lower edge of the side plate for a predetermined length.

9. The collapsible box according to claim 1, wherein one pair of the two pairs of opposite side plates are opposite long side plates, and the other pair are opposite short side plates, wherein the long side plates and the short side plates are hinged to the base and foldable relative to the base, wherein closed cavities along the height direction are provided in left and right end parts of the long side plates, wherein the closed cavities in the left and right end parts of the long side plate are located between an inner side surface and an outer side surface of the long side plates.

10. The collapsible box according to claim 9, wherein the closed cavities in the left and right end parts of the long side plate extend from the bottom of the long side plate to the top of the long side plate.

11. The collapsible box according to claim 9, wherein the left and right ends of the long side plate are respectively provided with a connecting part, wherein the closed cavities in the left and right end parts of the long side plate are formed in the connecting parts.

12. The collapsible box according to claim 11, wherein the outer side of the connecting part is provided with an engaging structure, and a corresponding engaging structure is also provided on the short side plate, the engaging structure on the short side plate and the engaging structure on the long side plate are engageable with each other.

13. The collapsible box according to claim 9, wherein the upper edge of the long side plate and/or the short side plate is provided with a closed cavity extending in the length direction thereof.

14. The collapsible box according to claim 9, wherein the lower edge of the long side plate and/or the short side plate is provided with a closed cavity extending in the length direction thereof.

15. The collapsible box according to claim 9, wherein the left and right ends of the long side plate are provided with connecting parts, wherein the left and right ends of the short side plate are provided with connecting parts engageable with the connecting parts of the long side plates; and closed cavities extending along the height direction of side plates are formed in the left and right end parts of the long side plate and/or the short side plate.

16. The collapsible box according to claim 15, wherein the closed cavities in the left and right ends of the long side plate extend from the bottom to the top of the long side plate, and the closed cavity of the short side plate is composed of a first section closed cavity, wherein the first section closed cavity extends from the bottom of the short side plate to the bottom of a mounting hole of a locking mechanism.

* * * * *